US007793857B2

(12) United States Patent
Westerhoff et al.

(10) Patent No.: US 7,793,857 B2
(45) Date of Patent: Sep. 14, 2010

(54) FIXING MEANS FOR FIXING RAILWAY LINES TO SLEEPERS OR STRETCHES OF TRACK

(75) Inventors: Karsten Westerhoff, Wetter (DE); Jörg Brecht, Olpe (DE); Erik Danneberg, München (DE); Andreas Rinsdorf, Freudenberg (DE); Bernfried Hesselmann, Wenden (DE); Vladimir Kobelev, Attendorn (DE); Michael Stahl, Olpe (DE)

(73) Assignee: DB Netz AG, Frankfurt (DE)

( * ) Notice: Subject to any disclaimer, the term of this patent is extended or adjusted under 35 U.S.C. 154(b) by 240 days.

(21) Appl. No.: 12/085,890

(22) PCT Filed: Nov. 7, 2006

(86) PCT No.: PCT/EP2006/010666

§ 371 (c)(1),
(2), (4) Date: Jun. 2, 2008

(87) PCT Pub. No.: WO2007/065516

PCT Pub. Date: Jun. 14, 2007

(65) Prior Publication Data

US 2009/0152369 A1 Jun. 18, 2009

(30) Foreign Application Priority Data

Dec. 7, 2005 (DE) ..... 10 2005 058 444

(51) Int. Cl.
*E01B 9/00* (2006.01)

(52) U.S. Cl. ..... 238/349; 238/351; 238/352; 238/356; 238/310; 238/343

(58) Field of Classification Search ..... 238/349, 238/351, 352, 356, 310, 323, 343
See application file for complete search history.

(56) References Cited

U.S. PATENT DOCUMENTS 3,297,253 A * 1/1967 Astley et al. ..... 238/349

(Continued)

FOREIGN PATENT DOCUMENTS

DE 1 025 439 9/1955

(Continued)

OTHER PUBLICATIONS

International Search Report.

*Primary Examiner*—S. Joseph Morano
*Assistant Examiner*—Jason C Smith
(74) *Attorney, Agent, or Firm*—Collard & Roe, P.C.

(57) ABSTRACT

The invention relates to fixing means for fixing railway lines to sleepers or stretches of track, comprising an elastic rail clip (51) and a clip anchor element (31). According to the invention, the elastic rail clip (51) has retaining elements that can be inserted into the clip anchor element (31) and guided into the latter by being rotated about a rotational axis (D) and at least one pressure bow (52), which can be brought into pre-tensioned contact with the foot (24) of a railway line (21), when the elastic rail clip is rotated (51) about the rotational axis (D) in relation to the clip anchor element (31). The elastic rail clip (51) has essentially annular clip bows (55, 56) that act as the retaining elements and the clip anchor element (31) has guide elements (34) that are concentric with the rotational axis (D).

24 Claims, 22 Drawing Sheets

U.S. PATENT DOCUMENTS

Figure 1A:
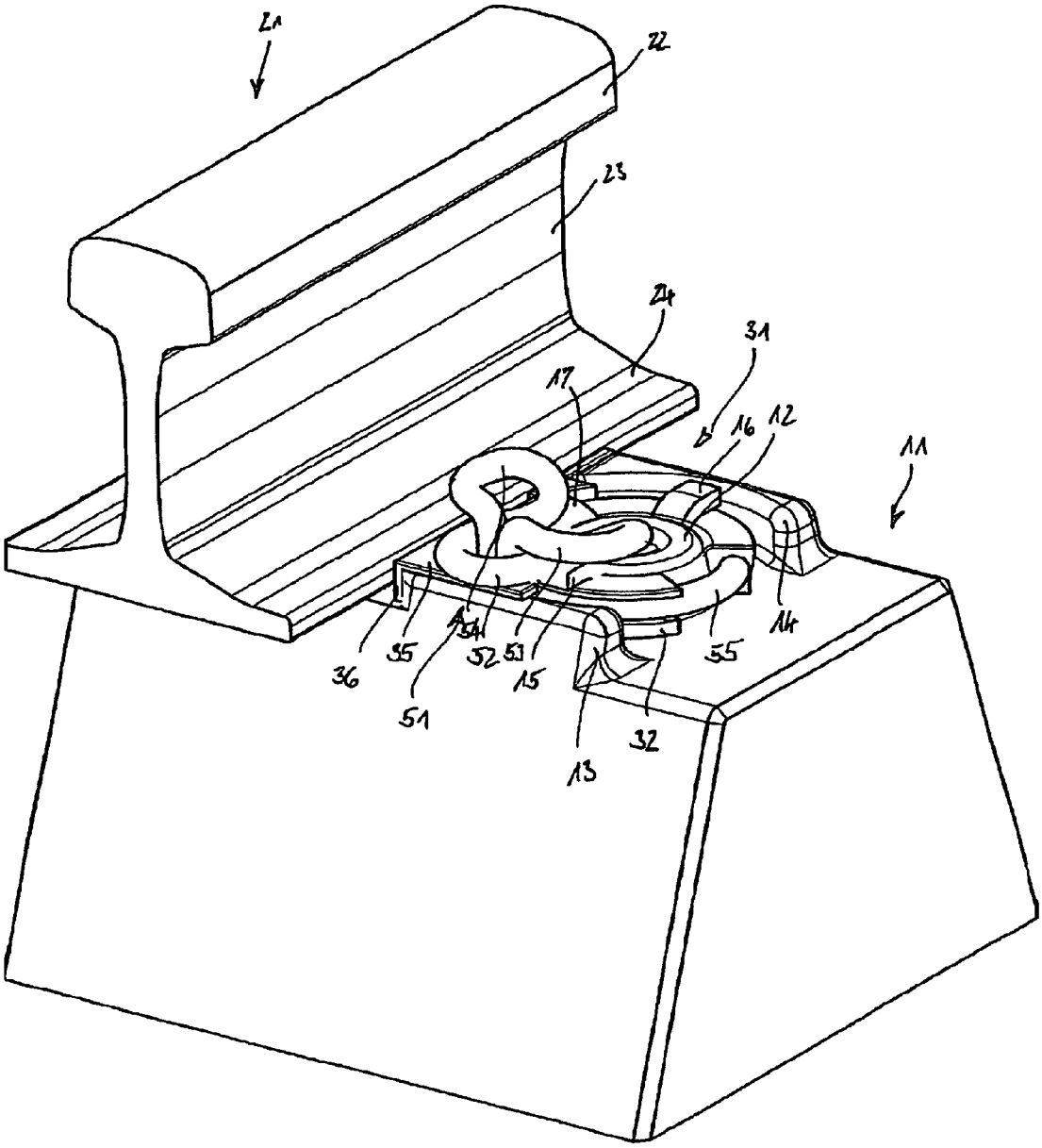
Figure 16:
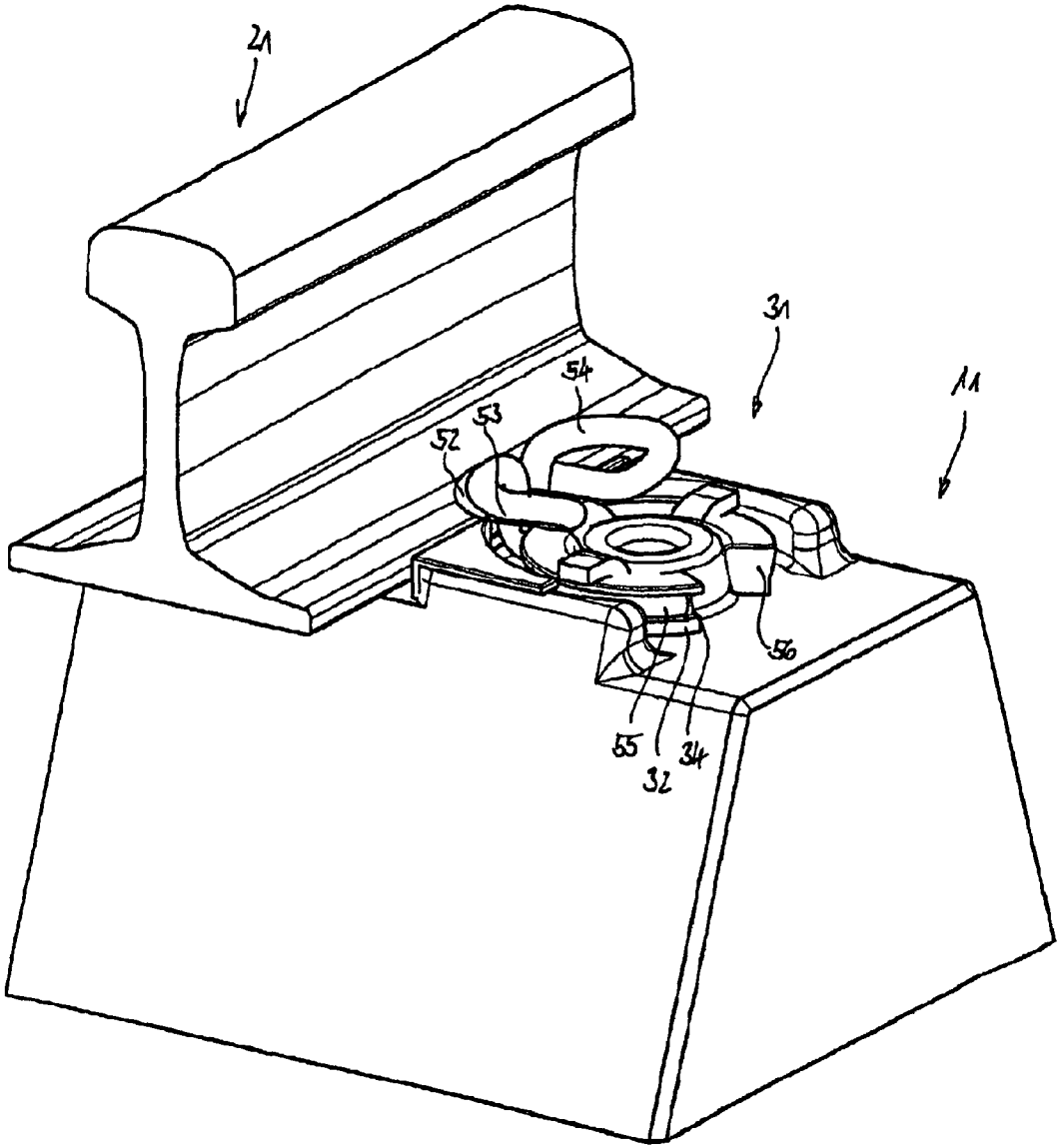

| | | | | | |
|---|---|---|---|---|---|
| 4,190,200 | A * | 2/1980 | Morrow | 238/349 |
| 4,705,215 | A * | 11/1987 | Eisenberg et al. | 238/349 |
| 4,927,078 | A * | 5/1990 | Vanotti | 238/349 |
| 4,978,065 | A * | 12/1990 | Deuchemin | 238/366 |
| 5,042,717 | A * | 8/1991 | Vanotti | 238/349 |
| 5,069,386 | A * | 12/1991 | Duval | 238/349 |
| 5,096,119 | A * | 3/1992 | Schultheiss et al. | 238/349 |
| 5,203,501 | A * | 4/1993 | Vanotti | 238/265 |
| 5,221,044 | A * | 6/1993 | Guins | 238/349 |
| 5,678,762 | A * | 10/1997 | Wood et al. | 238/351 |
| 5,718,376 | A * | 2/1998 | Cox et al. | 238/349 |
| 6,257,495 | B1 * | 7/2001 | Eisenberg | 238/349 |
| 6,702,192 | B2 * | 3/2004 | Igwemezie | 238/338 |
| 6,830,199 | B1 * | 12/2004 | Jang | 238/310 |
| 7,637,438 | B2 * | 12/2009 | Schwiede et al. | 238/349 |
| 2002/0000475 | A1 * | 1/2002 | Igwemezie | 238/338 |
| 2008/0237363 | A1 * | 10/2008 | Hauschild et al. | 238/349 |
| 2009/0084864 | A1 * | 4/2009 | Bosterling et al. | 238/349 |
| 2009/0152369 | A1 * | 6/2009 | Westerhoff et al. | 238/349 |
| 2009/0302126 | A1 * | 12/2009 | Wirthwein et al. | 238/349 |

FOREIGN PATENT DOCUMENTS

| | | |
|---|---|---|
| DE | 1 205 439 | 11/1965 |
| EP | 0 468 945 | 1/1992 |
| EP | 0 498 761 | 8/1992 |
| GB | 807873 | 1/1959 |
| GB | 977 366 | 12/1964 |
| JP | 2002-038405 | 2/2002 |
| WO | WO 89/03452 | 4/1989 |
| WO | WO 90/15192 | 12/1990 |

* cited by examiner

FIXING MEANS FOR FIXING RAILWAY LINES TO SLEEPERS OR STRETCHES OF TRACK

CROSS REFERENCE TO RELATED APPLICATIONS

This application is the National Stage of PCT/EP2006/010666 filed on Nov. 7, 2006, which claims priority under 35 U.S.C. §119 of German Application No. 10 2005 058 444.6 filed on Dec. 7, 2005. The international application under PCT article 21(2) was not published in English.

The present invention relates to fixing means for fixing railway lines to sleepers or stretches of track as well as fixing means comprising an elastic rail clip and a clip anchor element. The invention furthermore comprises sleepers or stretches of track into which the clip anchor elements of the mentioned fixing means are inserted or cast. The sleepers, like the corresponding stretches of track designed integrally, are preferentially made of concrete.

To hold the railway lines, which are backed by elastic and electrically insulating supports relative to the sleepers or the stretch of track, predominantly elastic rail clips of bent wire are used which are held in corresponding anchorage elements which are fitted or inserted in the sleepers or the stretch of track. For the assembly, the elastic rail clips are displaced above the rail foot in transverse direction to the railway line, wherein clamping screws to be turned more preferably into plastic dowels are utilized as clamping means for clamping the elastic rail clip to the rail foot.

Rail fixing means of the mentioned type are known in a large variety.

Elastic rail clips bent from wire are known from EP 0498 761 B1 which, starting from an elastic clip, comprise a straight vertical tensile section and a bent hook at the lower end, wherein the elastic clip through twisting about the vertical section can be swivelled in over the rail foot.

In addition, a rail clip is known from EP 0468 945 B1, wherein a compression spring is tensioned on a tensile anchor which is cast into the sleeper, wherein a rotatable arm is arranged under the compression spring which for fixing is to be swivelled through rotation over the rail foot of the rail.

Fixing means for the fixing of railway lines on sleepers are known from WO 90/15192 which comprise an elastic rail clip and a clip anchor element. The elastic rail clip comprises retaining elements which can be inserted in the clip anchor element in such a manner that they are rotatably guided about a rotational axis in said clip anchor element, and at least one pressure bow which on rotating the elastic rail clip relative to the clip anchor element about the rotational axis can be brought into pre-tensioned contact with the rail foot of a railway line. The fixing means of the elastic rail clip are substantially bent annular clip bows; the clip anchor element comprises concentric guide elements relative to the rotational axis that can engage in the clip bows.

An elastic rail nail, comprising two nail shanks and two loops, which when driven in form a vertical stop for a pressure arm or pressure bow is known from DE 1025 439 A.

A rail nail with two shanks is likewise known from JP 2002-038 405 A which shanks are connected with a pressure bow via two loops in such a manner that the two loops on driving-in form a vertical stop for the arms of the pressure bow.

Today, rail fixing systems of this type are subjected to high demands, while train speeds of up to 300 km/h, track radii >=150 m and wheel set loads of up to 25 tons have to be used as a base for the design. In addition, elastic mounting of the rails relative to the sleepers or the stretch of track has to be ensured over the entire usual lying period of the system.

The elasticities of the system rail/sleeper are supposed to differ for the three different three-dimensional directions (rail longitudinal direction, rail vertical direction, rail transverse direction). The characteristics must be maintained permanently.

In addition, for safety reasons, lifting-off of the rail with its rail foot on one side by more than 2 mm must be prevented through positive fixing of the rail relative to the sleepers or the stretch of track in order to prevent complete tipping over of the rail in extreme situations.

Starting from WO 90/15192 the invention is based on the object of providing fixing means or a sleeper or a stretch of track with such fixing means which, with reduced number of parts, allows an extremely rational manner of clamping of the fixing system.

The solution of this object is contained in the Claims 1, 23 and 24.

According to the invention it is provided that the fixing means, which comprise an elastic rail clip and a clip anchor element, are designed in such a manner that the elastic rail clip comprises retaining elements which can be inserted in the clip anchor element and guided in the latter by being rotated about a rotational axis (D) and at least comprises one pressure bow which can be brought into pre-tensioned contact with the foot of a railway line when the elastic rail clip is rotated about the rotational axis (D) in relation to the clip anchor element, and that the elastic rail clip has essentially annular clip bows that act as retaining elements and the clip anchor element has guide elements that are concentric with the rotational axis, wherein the clip bows and the guide elements each cover a guide plane which is located vertically to the rotational axis (D), wherein the elastic rail clip comprises an arc-shaped pressure bow, the two clip bows covering a guide plane as well as two spring loops connecting the clip bows with the pressure bow, wherein the ends of the spring loops connected with the clip bows form upright bows which run approximately vertically to the guide plane and the ends of the spring loops connected with the pressure bow are guided through between the guide plane and the ends of the spring loops connected with the clip bows. Thus, the pressure bow is enclosed in three three-dimensional directions by the elastic rail clip:

- axis-parallel to the rotational axis (D) upwards from each of the parts of the spring loops adjoining both upright bows,
- to the inside from in each case one of the two vertical upright bows,
- as well as axis-parallel to the rotational axis (D) to from the two clip bows (or the guide plane covered by the clip bows).

The spring loops which are located above the pressure bow because of this form a vertical stop for the pressure bow against excessive bending-out under overload in the direction away from the clip bows. The guide elements can more preferably consist of an annular outer guide slot in which the clip bows engage in an elastic manner. Insofar as the elastic rail clip is bent from round wire the guide slot has a suitably adapted round cross section open towards the outside. Here, the guide slot is formed on a part which is permanently joined with the sleeper, if applicable even formed directly in the sleeper. The elastic rail clip with its clip bows that can be bent open elastically can be inserted in a pre-assembly position in the guide slot. In this pre-assembly position the pressure bow faces in a direction in which it does not obstruct placing of a railway line onto the sleeper, for example in a position facing in the direction across the sleeper. In this pre-assembly position the elastic rail clip, i.e. more preferably the spring bow, can already be elastically pre-tensioned.

Once the railway line has been placed onto the sleeper the elastic rail clip which is retained in a rotatable manner is twisted so far that the pressure bow arrives in its assembly position in which it faces in the direction of the sleeper to the railway line and rests on the rail foot approximately symmetrically. On reaching of the assembly position engaging of the elastic rail clip in engaging means of the guide elements can occur simultaneously. Thus the elastic rail clip is secured against inadvertent loosening. On sliding-up of the pressure bow onto the rail foot the pre-tension can still increase to a minor degree. With the fixing means according to the invention the final assembly, starting from the pre-assembly position, only requires a rotary movement of the elastic rail clip by approximately 90°, which can be executed with conventional rotating tools in a very short time. The fixing means proper can be simply designed and manufactured cheaply, as is evident from the further description.

According to a particularly advantageous embodiment it is provided that the guide slot is formed in a guide ring which more preferably is positively held on the sleeper. To radially fix the guide ring a centring body formed from the material of the sleeper in cone form or ring form can be provided on which the guide ring is placed. In order to hold the guide ring, which in an advantageous manner can consist of plastic, axially in the direction of the rotational axis, anchor hooks cast into the body of the sleeper have to be provided which reach over the guide ring. Provided the guide ring is split on the circumference it can be pushed onto the centring body radially to the rotational axis following the completion of the sleeper and the casting-in of the anchor hooks. The elastic rail clip proper with its clip bows can either be inserted in the guide slot radially or axially to the rotational axis and twisted from the pre-assembly position into its assembly position, in which the pressure bow radially protruding to the outside contacts the rail foot under pre-tension.

According to a further embodiment it is provided that symmetrically to the centring body two stop elements running in sleeper longitudinal direction are formed out of the sleeper, which serve to support the rail foot of the railway line under transverse forces. Here it is simultaneously provided that, when the clip bows are seated in the guide elements and the pressure bow rests on one of the stop elements, the elastic rail clip is in a tensioned state. In order to avoid contact between steel and concrete when twisting the elastic rail clip relative to the clip anchor a slide protection element is placed on the stop elements according to a first embodiment which forms a direct support for the pressure bow during the twisting of the elastic rail clip. This slide protection element can be constructed as one piece with a stop strip for the rail foot which, under the influence of lateral forces on the rail, contacts the mentioned stop elements supporting itself on these. Slide protection elements and/or stop strip can be designed as one piece with the guide ring which thus can all consist of plastic.

According to a second embodiment it is provided that a cap-like slide protection element is fitted onto the pressure bow which forms the direct support for the pressure bow on at least one stop element and on the rail foot upon rotation about the rotational axis (D). Here it is more preferably proposed that on the cap-like slide protection element a stop strip for the rail foot of the railway line is moulded.

Figure 1C:
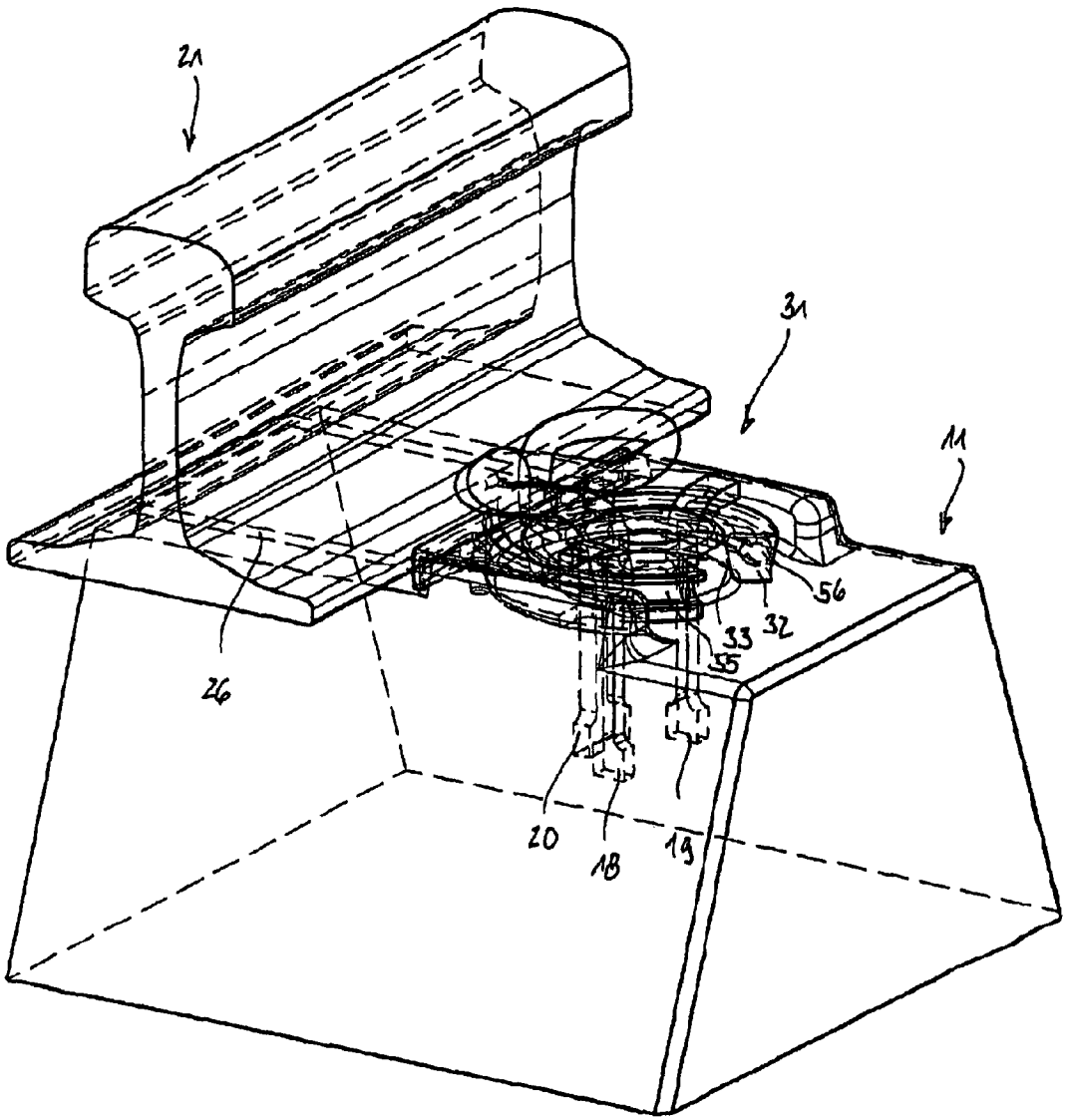

A preferred exemplary embodiment of the invention is shown in the drawings and described in the following:

FIG. 1 shows a sleeper with a rail section fixed with fixing means according to the invention in 3D-view

*a*) in a pre-assembly position

*b*) in a final-assembly position

*c*) in the final-assembly position with view of obscured lines;

FIG. 2 shows the arrangement according to FIG. 1 seen in longitudinal direction of the sleeper

*a*) view of the sleeper end in the pre-assembly position

*b*) view of the sleeper end in the final-assembly position

*c*) in cross section in the direction towards the sleeper end in the pre-assembly position FIG. 3 shows the arrangement according to FIGS. 1 and 2 seen in the direction of the rail

*a*) view in the pre-assembly position

*b*) view in the final-assembly position with hidden view lines

*c*) in section in the final-assembly position

FIG. 4 shows the arrangement according to FIGS. 1 to 3 seen in the direction of the rail opposite to FIG. 3

*a*) in the pre-assembly position

*b*) in the final-assembly position

Figure 4A:
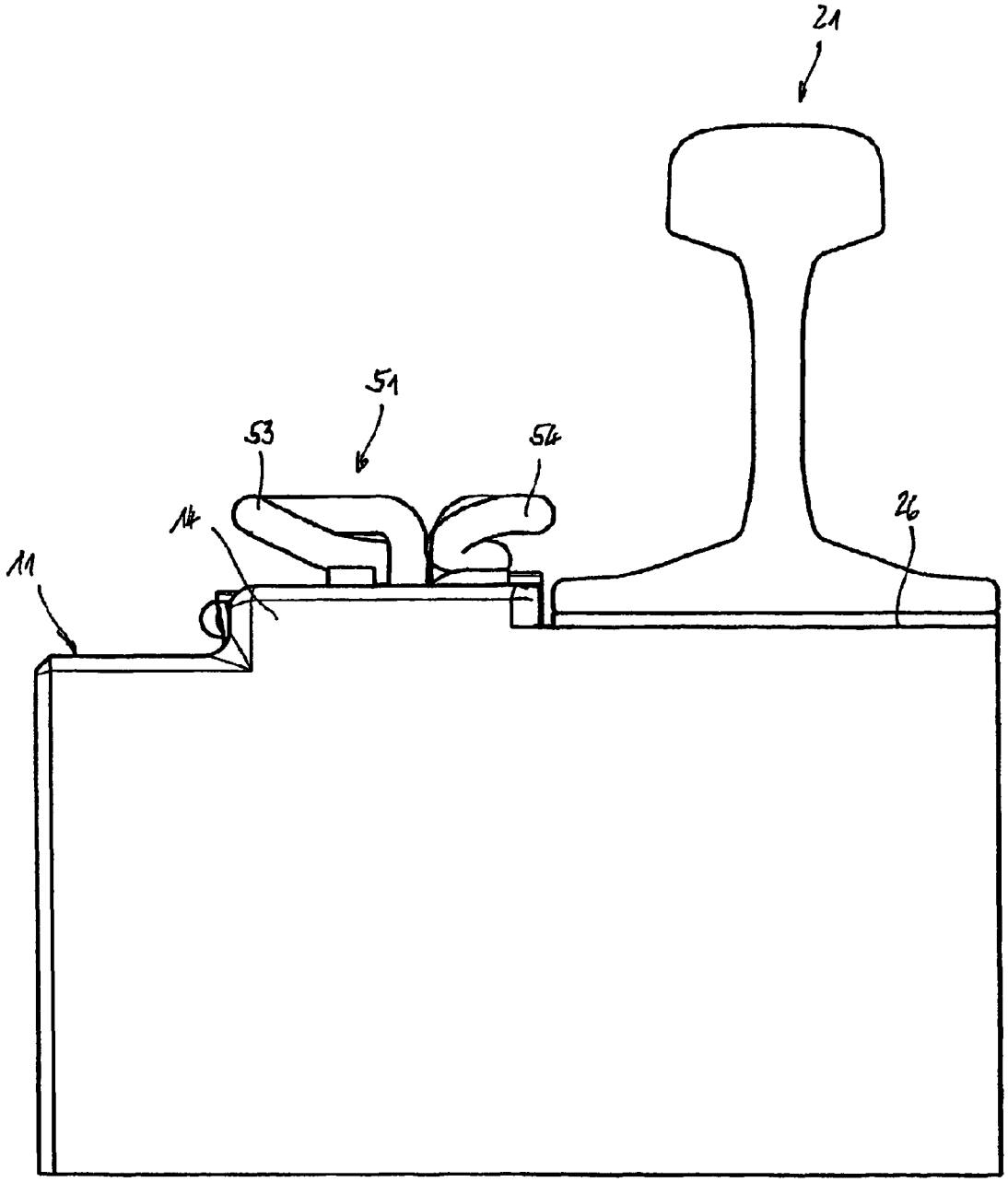
Figure 4B:
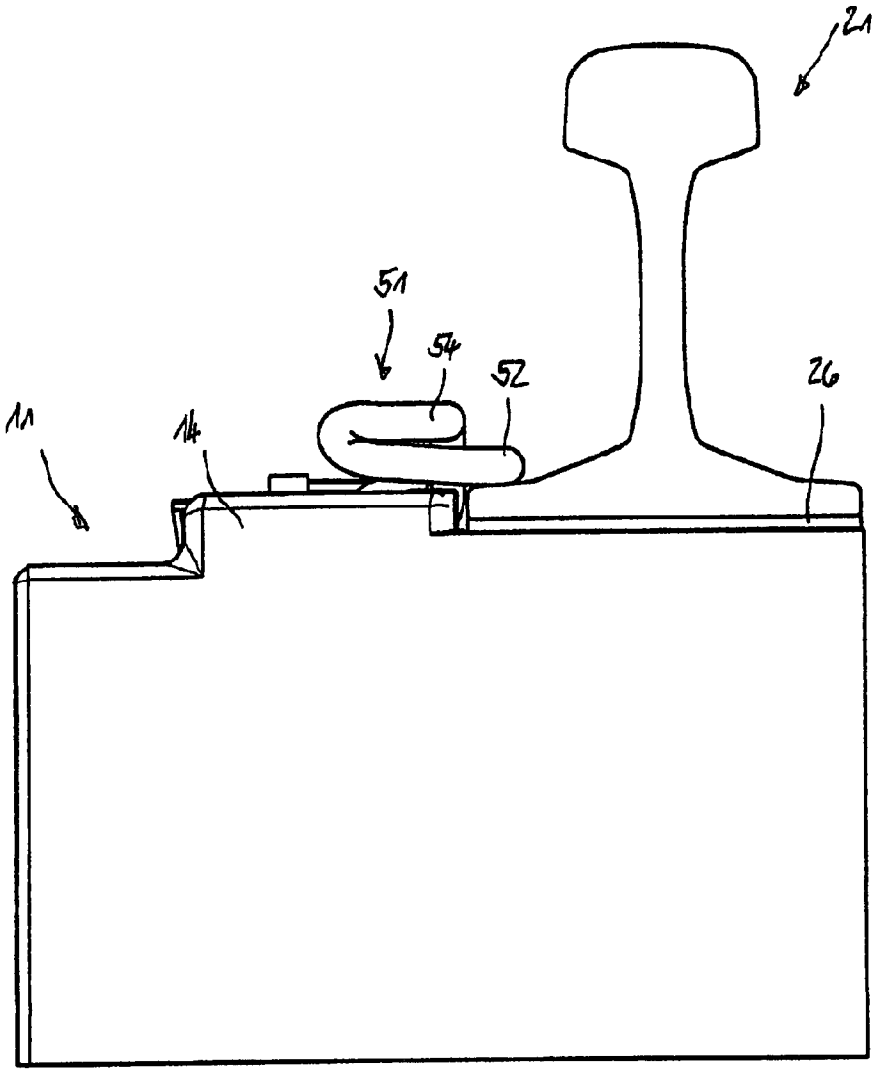
Figure 5A:
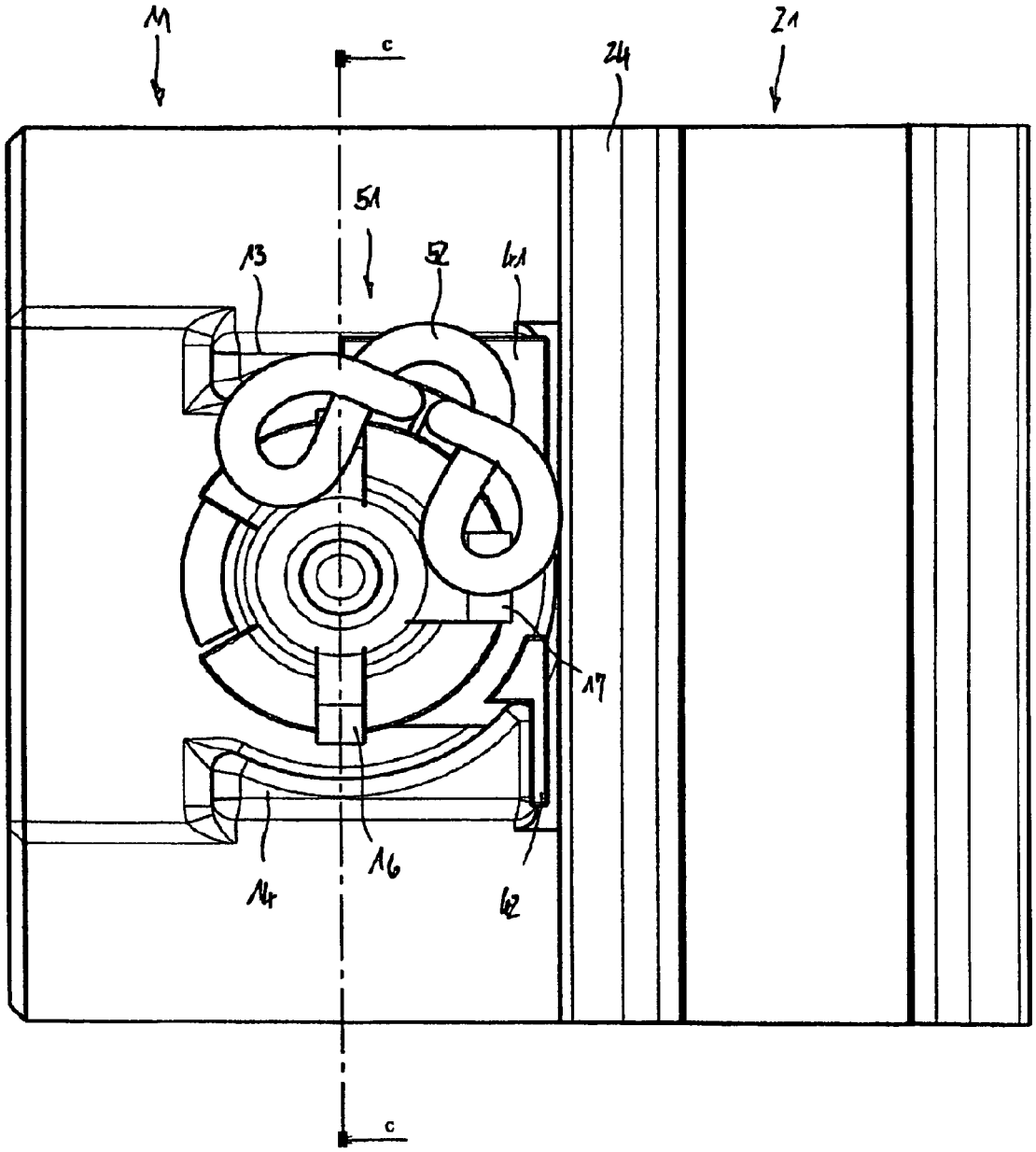
Figure 5B:
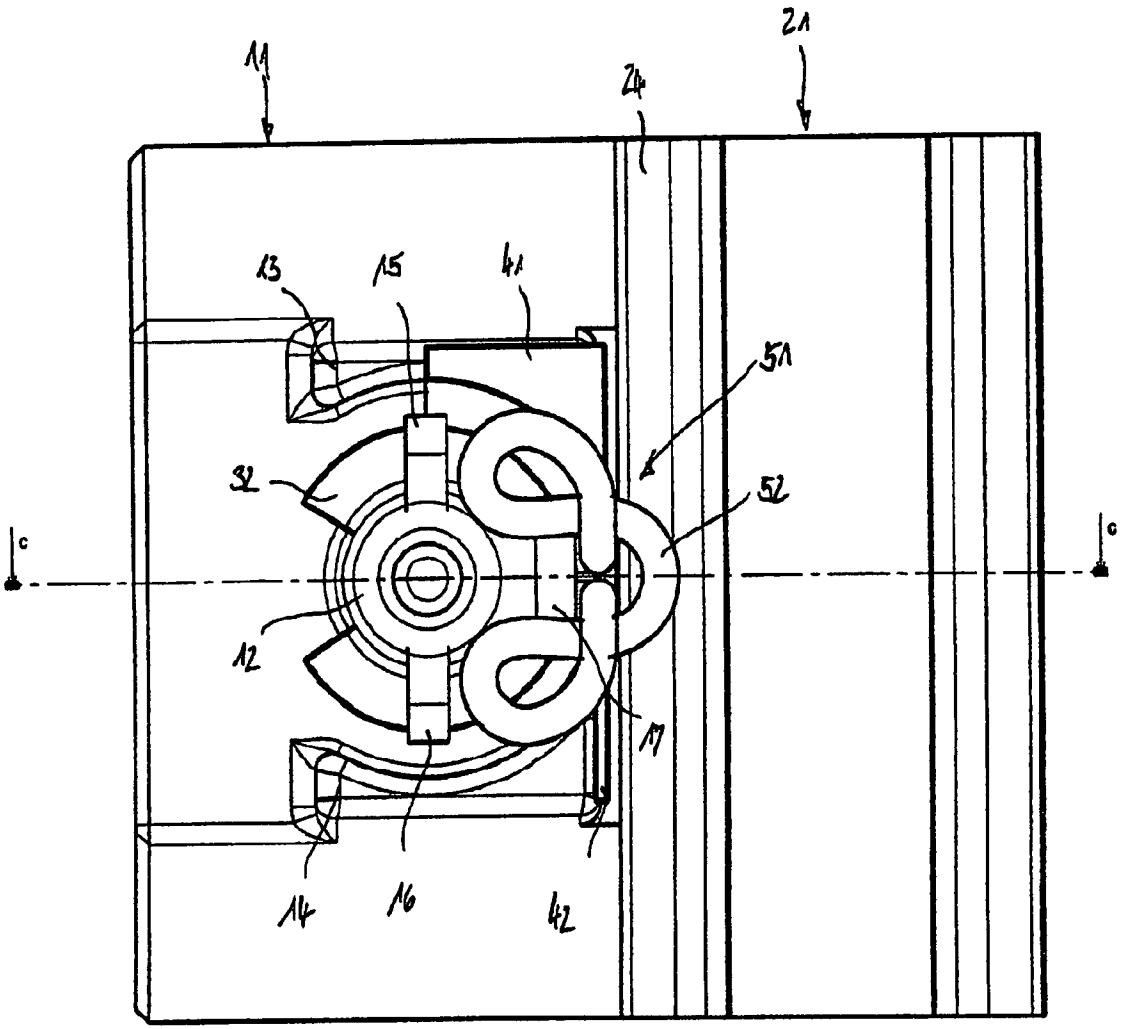
Figure 6A:
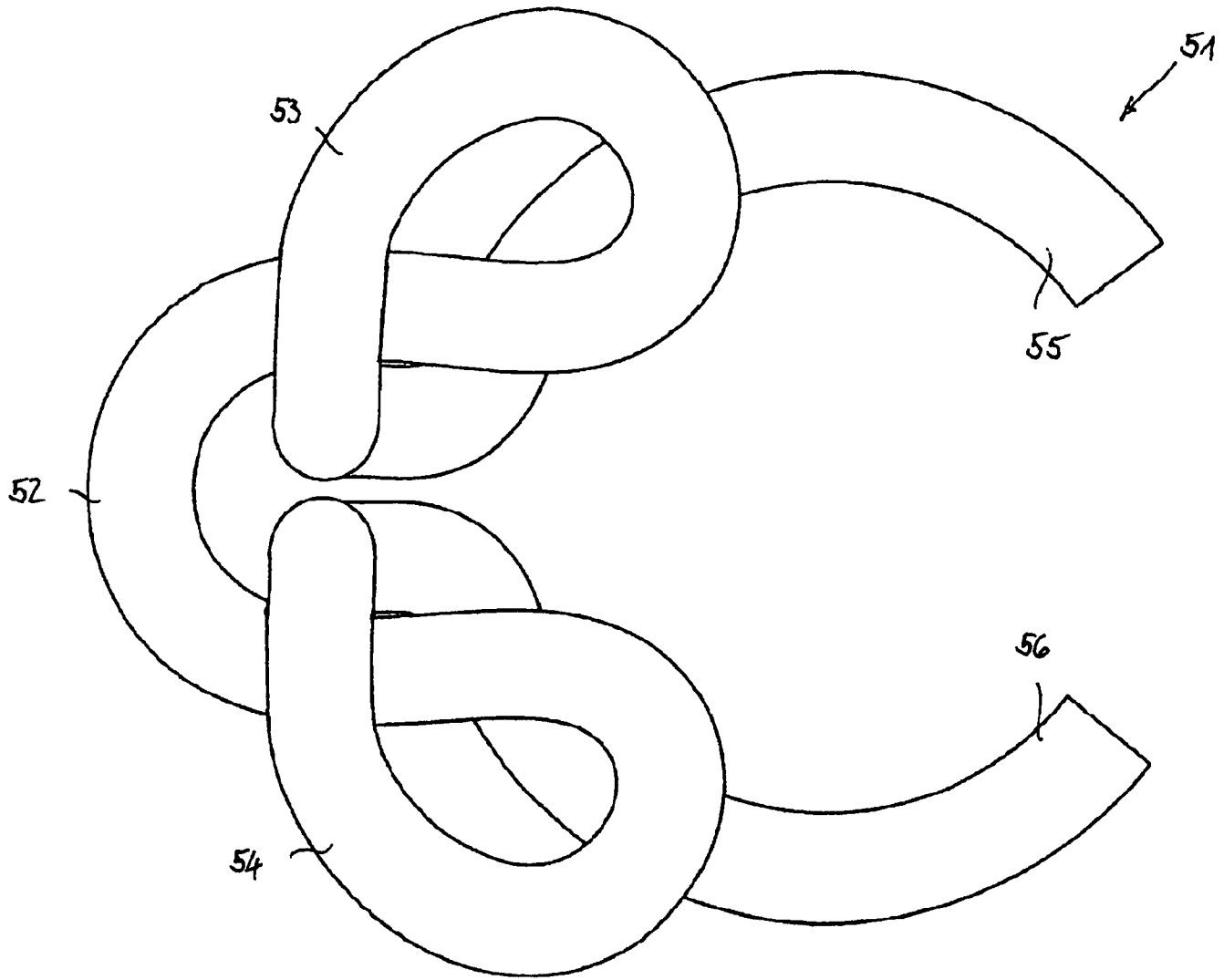
Figure 6B:
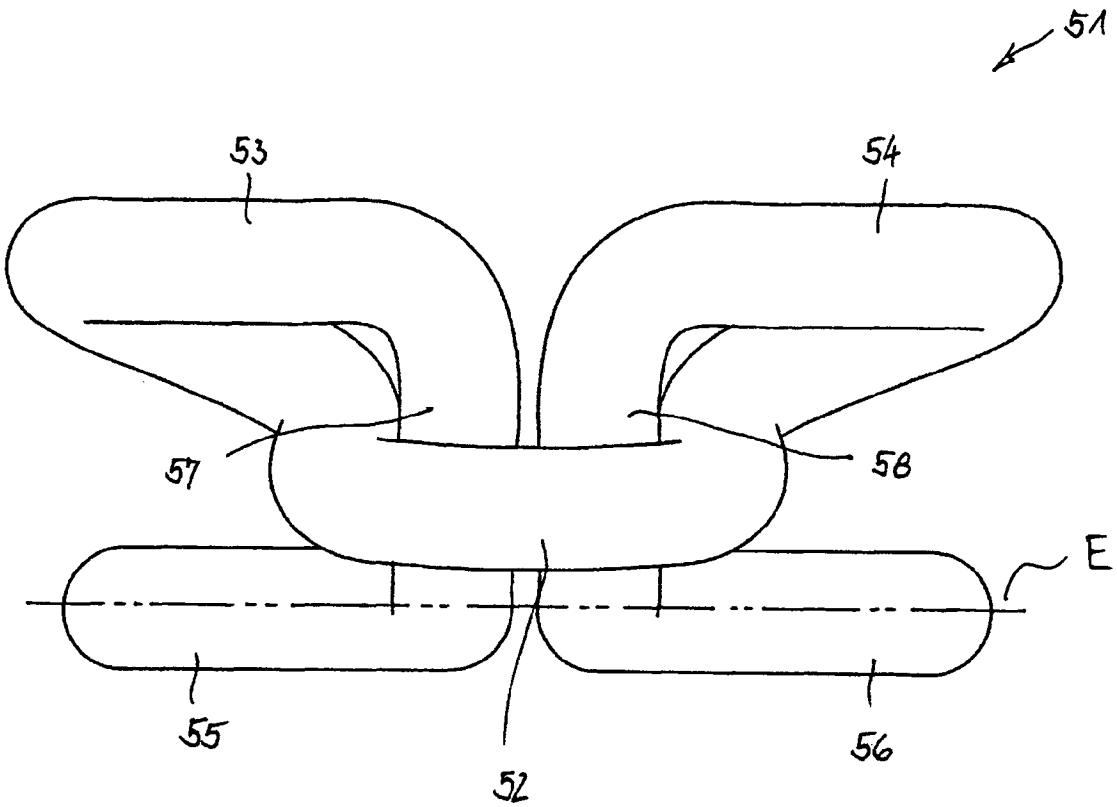
Figure 6C:
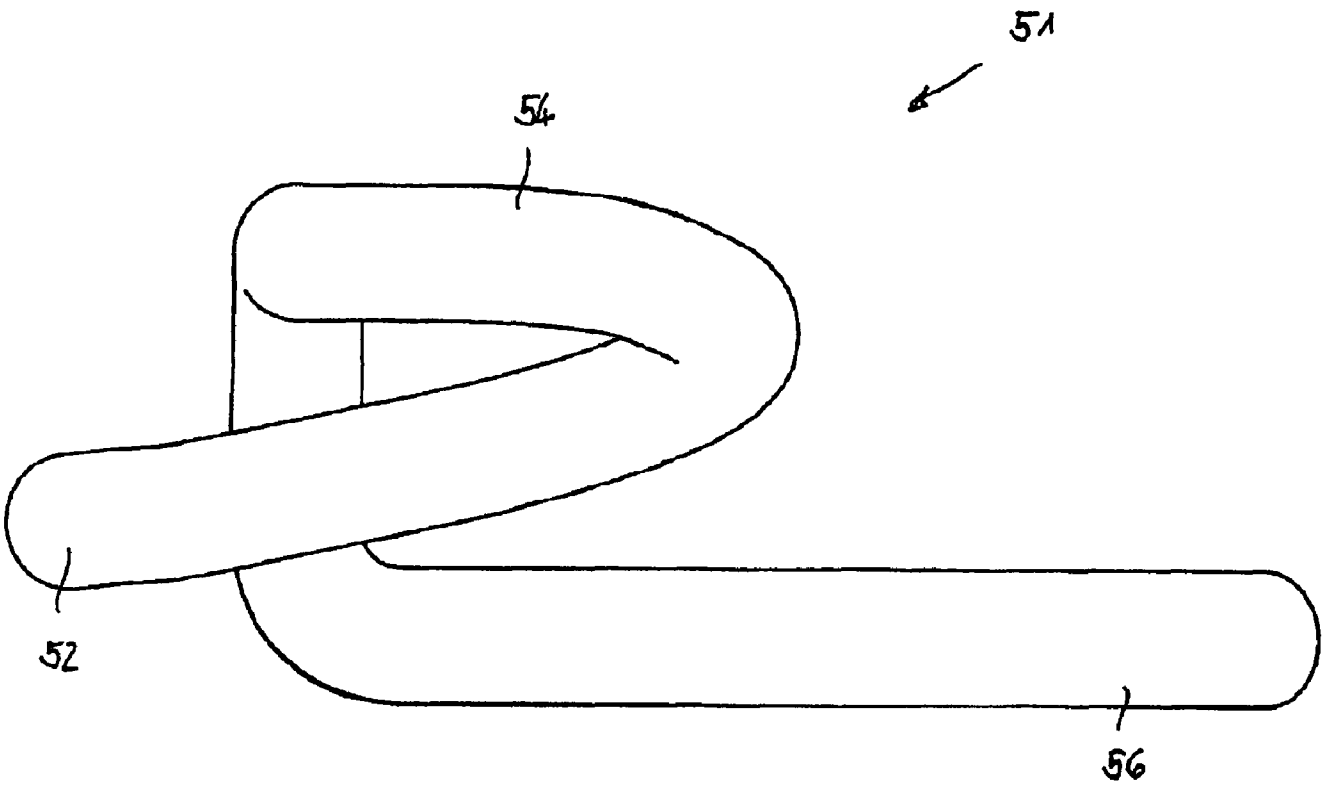
Figure 6D:
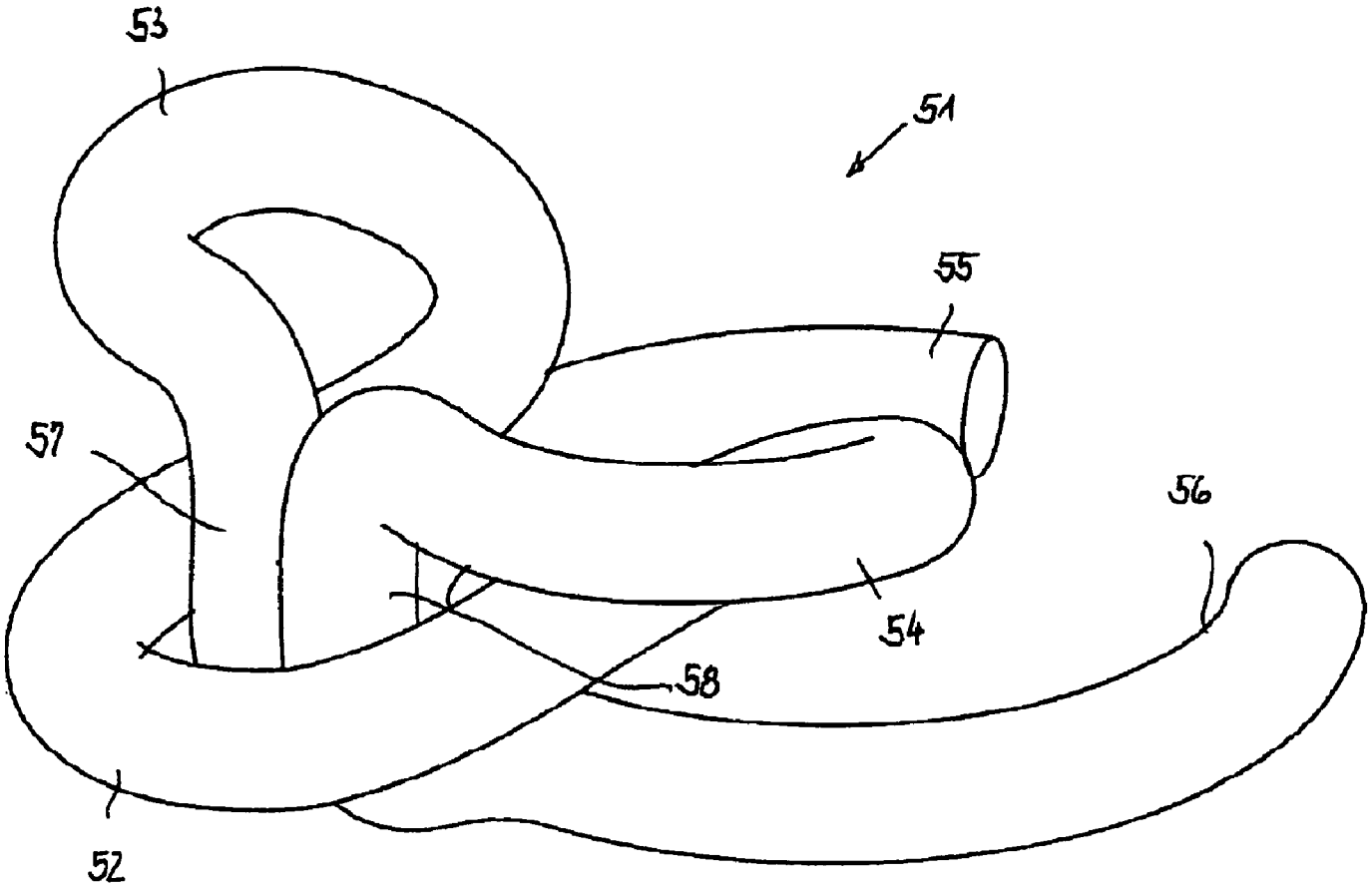
Figure 7A:
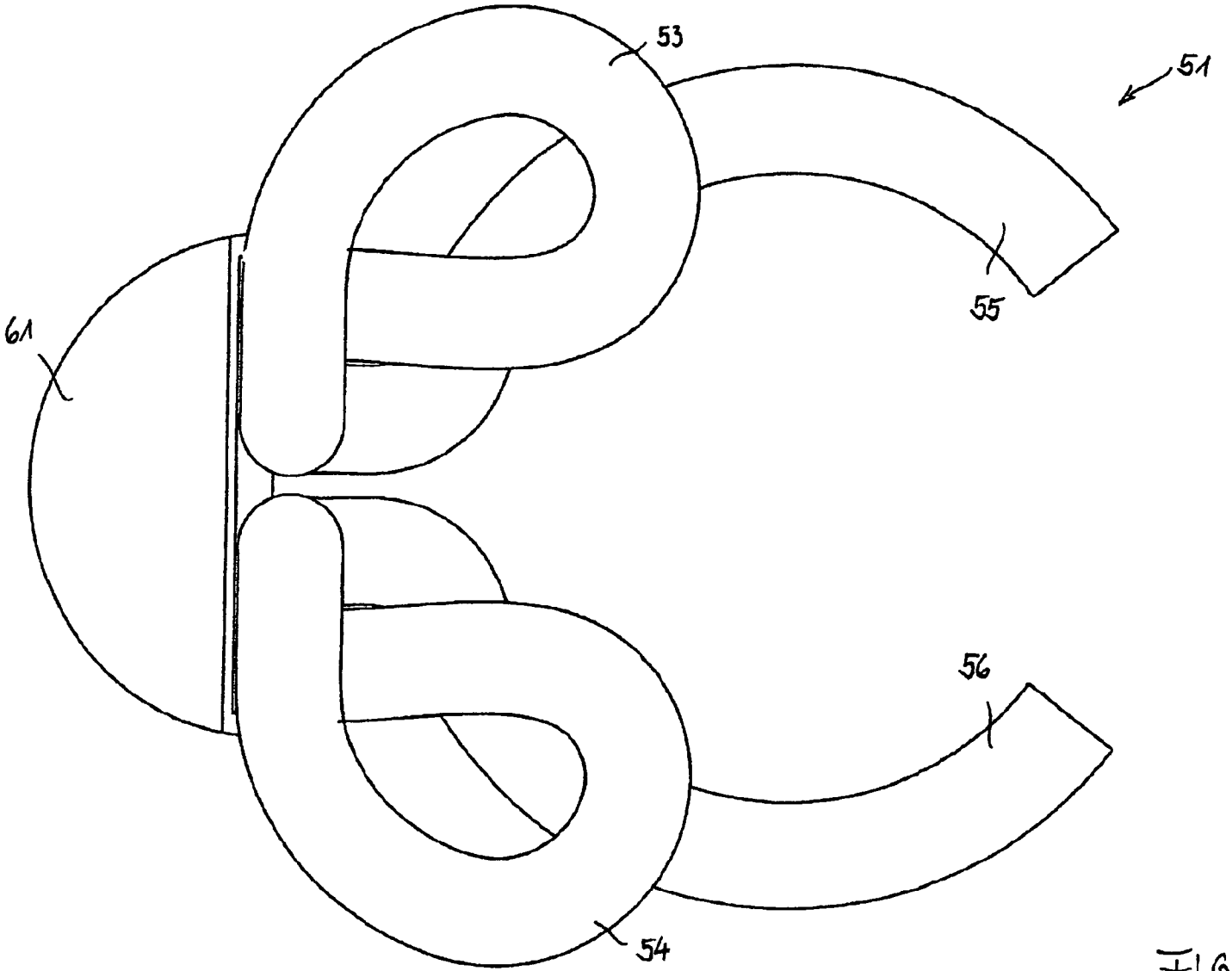
Figure 7B:
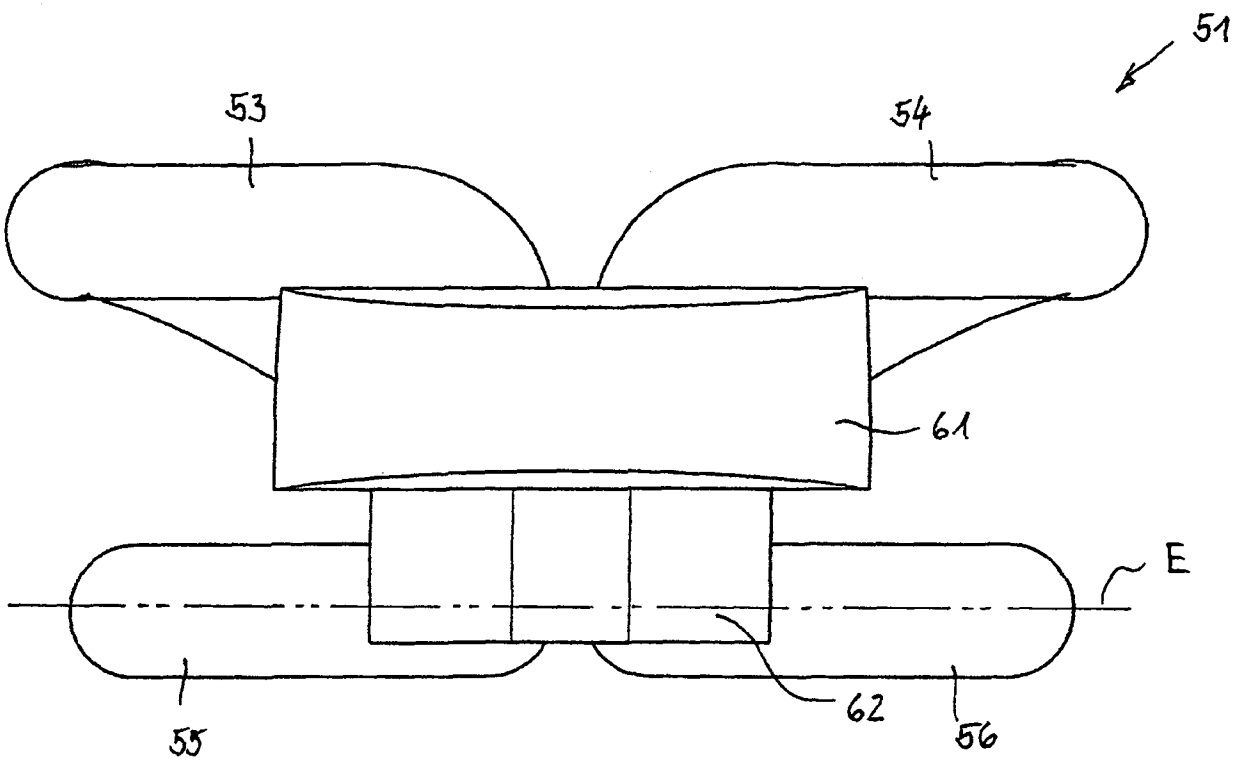
Figure 7C:
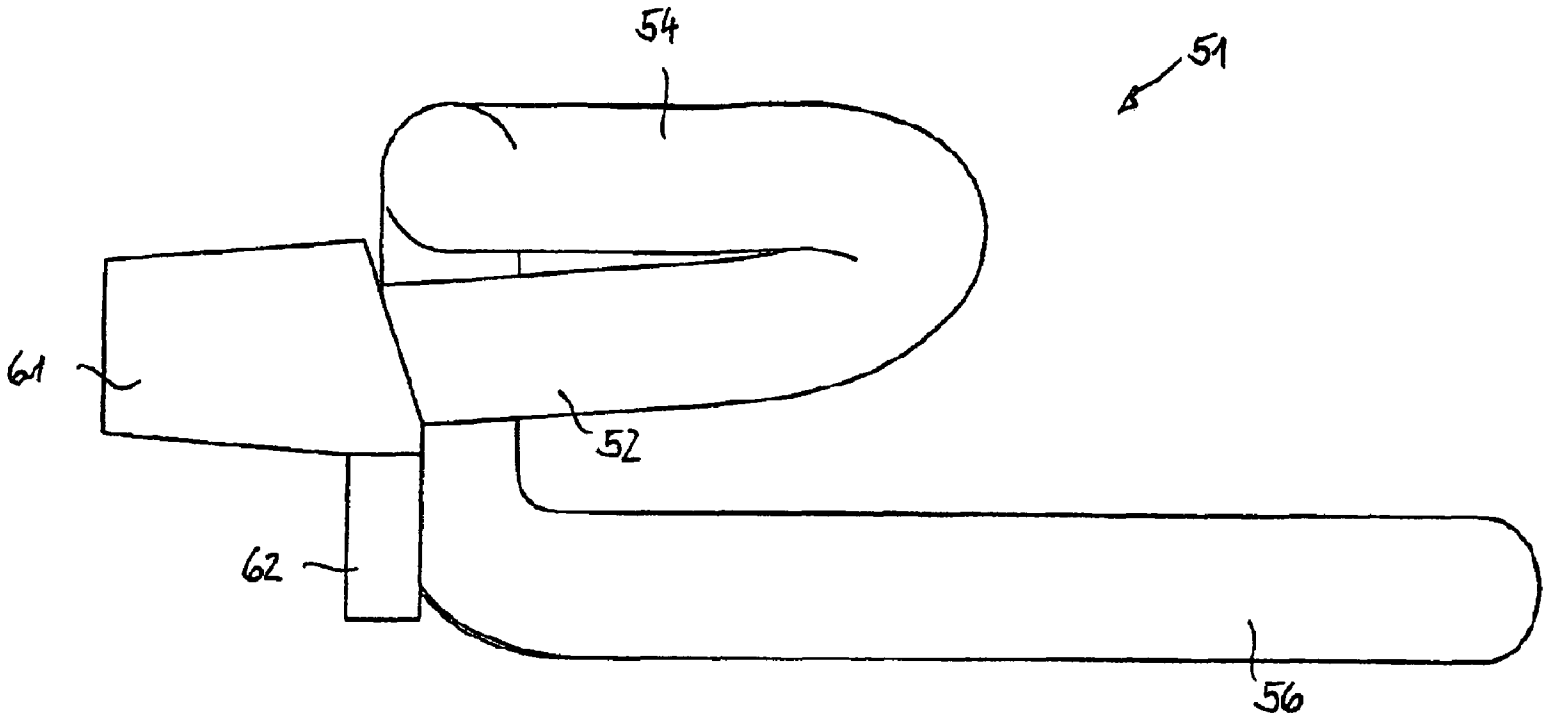
Figure 7D:
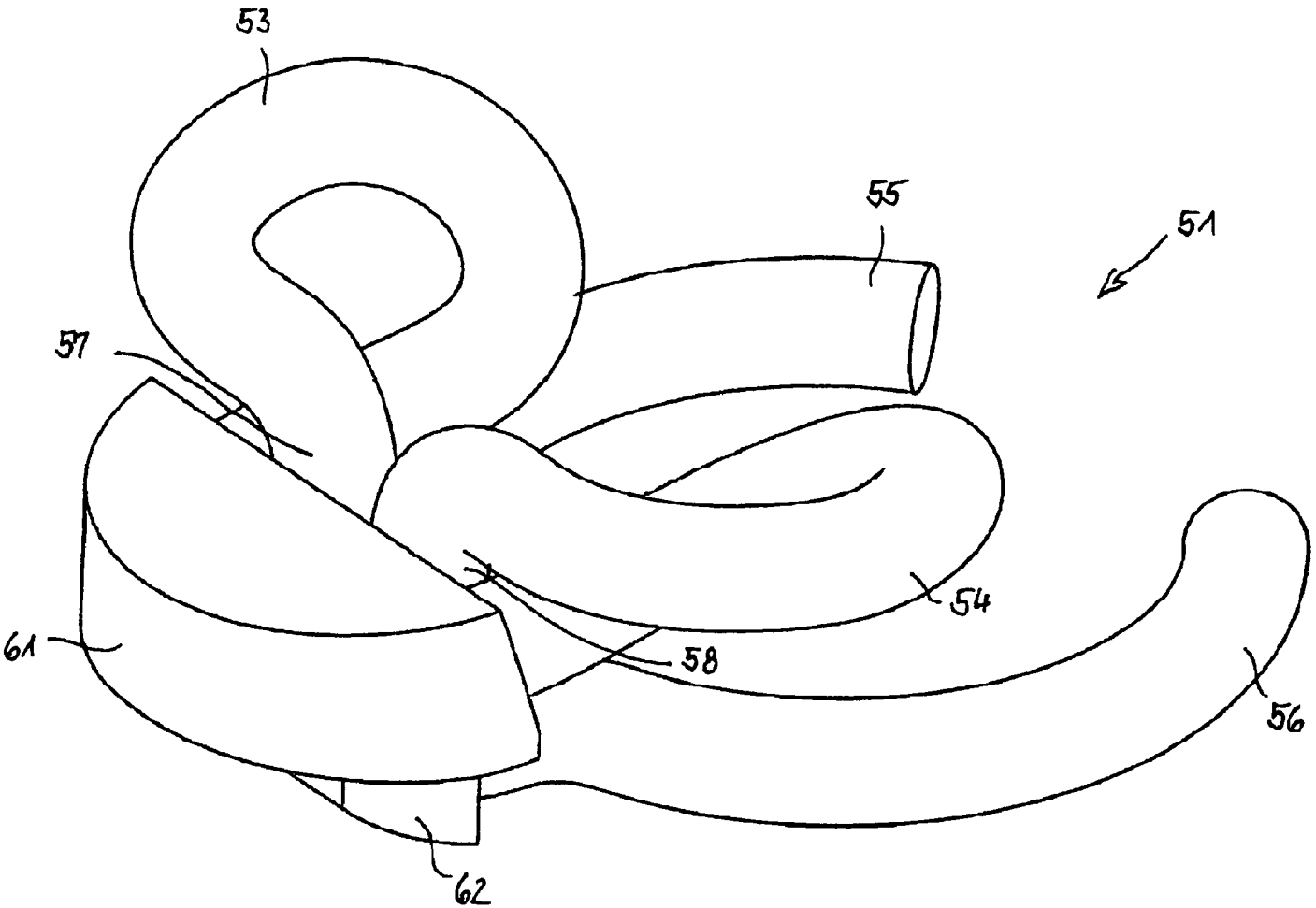

FIG. 5 shows the arrangement according to the FIGS. 1 to 4 in top view

*a*) in the pre-assembly position

*b*) in the final-assembly position

FIG. 6 shows an elastic rail clip according to the invention as a detail in the untensioned state

*a*) in top view

*b*) in end view

*c*) in lateral view

*d*) in 3D-view

FIG. 7 shows an elastic rail clip according to the invention as detail in the untensioned state with a slide and stop cap

*a*) in top view

*b*) in end view

*c*) in lateral view

*d*) in 3D-view

Figure 8:
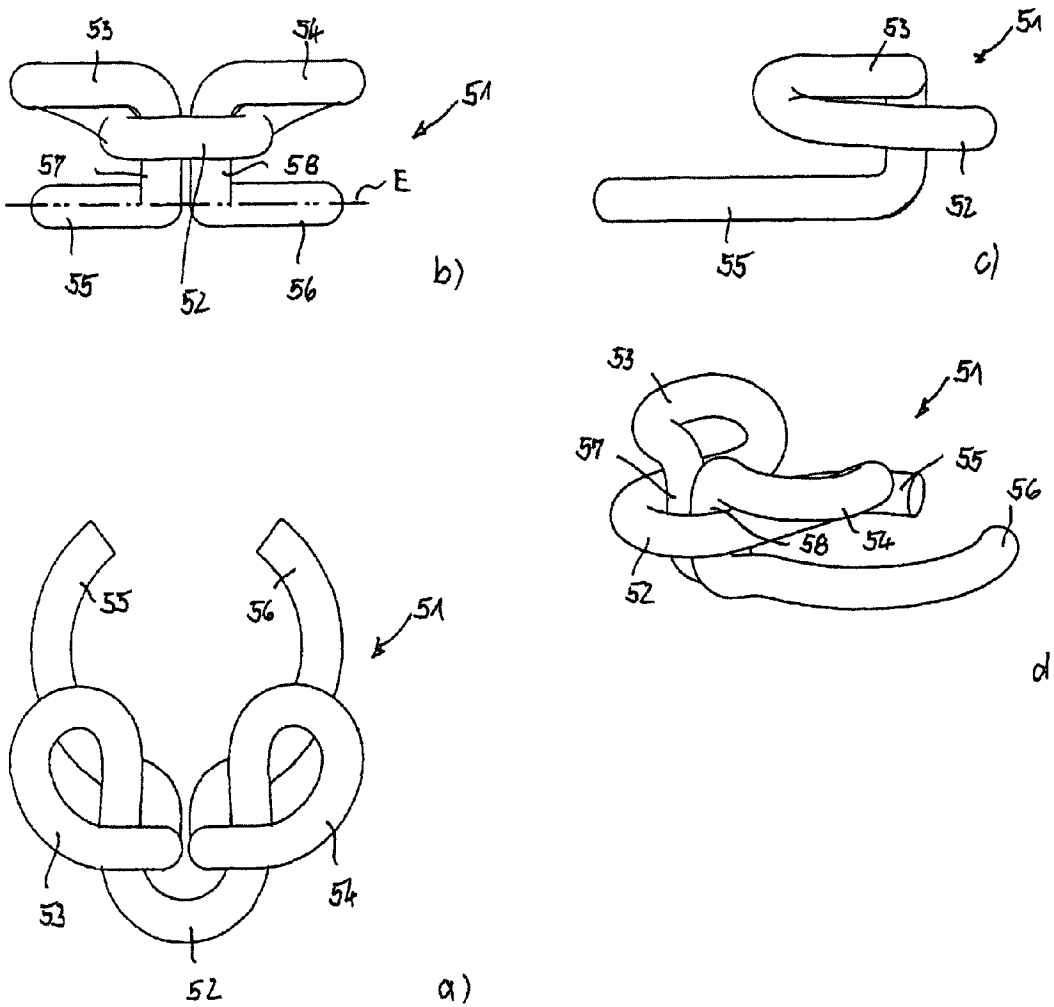

FIG. 8 shows an elastic rail clip according to the invention as detail in the pre-loaded state

*a*) in top view

*b*) in end view

*c*) in lateral view

*d*) in 3D-view

FIGS. 1*a*), 1*b*) and 1*c*) are described jointly in the following unless the description specifically relates to an individual one of the figures.

An arrangement according to the invention with a sleeper 11 only shown with its end section, a section of a railway line 21 resting on said sleeper and fixing means still to be explained in more detail is shown, which fixing means consist of a clip anchor element 31 and an elastic rail clip 51, wherein the latter are shown in two different positions. In the position according to FIG. 1*a*), a preassembly position is shown in which a railway line 21 can be placed onto the lying sleeper 11 from the top, wherein an elastic and electrically insulating rail support 26 is to be used. FIGS. 1*b*) and 1*c*) each show an assembly position or a final assembly position respectively in which the railway line 21 on one side is held to its rail foot 24 by means of the fixing means, wherein fixing means of the same type or embodied in a deviating manner can be added to the fixing means shown on the opposite side of the rail foot in order to completely secure the railway line. On the sleeper 11, at a lateral distance to the railway line 21, a centring body 12 of conical, more preferably annular shape is formed on which parts of the rail fixing means are centred. Furthermore, two stop elements 13, 14 are formed on the sleeper 11 likewise at a lateral distance to the railway line 21 which limit a lateral displacement of the railway line 21 under transverse forces and in addition to this form contact surfaces and support surfaces for additional parts of the fixing means. The railway line 21 comprises as details a rail head 22, a vertical land 23 and the rail foot 24 starting on both sides, on which the fixing means come to bear with pre-tension after the final assembly. The fixing means for the railway line 21 comprise several parts permanently connected with the sleeper 11, which altogether form the clip anchor element 31, and a detachable elastic rail clip 51 that can be braced against the first-mentioned parts and which acts on the rail foot of the railway line 21. The parts permanently connected with the sleeper 11 comprise a guide ring 32 which is placed on the centring body 12 and held in a centred manner on said centring body and which can consist of a material with favourable sliding properties, i.e. more preferably of plastic. The guide ring 32 is split to the circumference towards the end of the sleeper 11, as a result of which removal from the sleeper 11 is ensured. The guide ring 32 is axially held by three anchor hooks 15, 16, 17 which reach over the guide ring 32 from the inside hook-shaped and which are cast into the sleeper 11 and at their cast-in end have anchorage heads 18, 19, 20 each. With adequate elasticity of the guide ring 32 shown the latter can thus be pushed under the anchor hooks from the rail side or the sleeper end, and, if applicable, turned into its end position. When using an annular guide ring it is however conceivable in like manner that said guide ring is brought into its intended position even before the casting-in of the anchor hooks and during the manufacture of the sleeper is already finally positioned. The version of the guide ring capable of being disassembled more preferably consisting of plastic allows the exchange as wear part and is thus preferable.

The guide ring 32 has an inner cone 33 by means of which it is firmly positioned on the centring body 12 and an outer guide slot 34 in which the elastic rail clip 51, which is bent of wire and will still be described in more detail, engages positively and rotatably. A slide protection element 35 is placed on the stop elements 13, 14 which in top view is adjusted to the course of the intermediate space between centring body 12 and stop elements 13, 14, wherein it covers a substantial part of the stop element 13 and with a folded-down stop strip 36 covers the stop elements 13, 14 towards the railway line 21, so that the contact between railway line 21 and sleeper 11 is imparted through this contact strip 36. The slide protection element 35 is substantially manufactured of material of identical wall thickness, more preferably of plastic, and is placed on the elastic rail clip 51 prior to the assembly. During the movement of the elastic rail clip 51 from the preassembly position into the assembly position the pressure bow 52 of the elastic rail clip slides over the top of the slide protection element 35. The elastic rail clip 51 substantially consists of the mentioned pressure bow 52 two spring loops 53, 54 running symmetrically and lying above said pressure bow and two clip bows 55, 56 following the latter which, in adaptation to the guide slot 34 are bent around the centring body 12 in a centred manner and which can be inserted in the guide slot 34. During this, the elastic rail clip 51 can be clipped in the guide slot 34 of the guide ring 32 from the sleeper end, while the clip bows 55, 56 are pressed apart. In the process, the clip bows 55, 56 engage in the intermediate spaces between stop elements 13, 14 and guide ring 32 in a position which, compared with the one from FIG. 1*b*) is rotated by 90°. Starting from this position the elastic rail clip 51 is turned in clockwise manner as far as into the preassembly position according to FIG. 1*a*), in which the pressure bow 52 already rests in a pre-tensioned manner on the slide protection plate, wherein, upon further rotation, no contact can take place between the steel of the elastic rail clip 51 and the concrete of the sleeper. As already mentioned, the railway line 21 can be inserted in this preassembly position according to FIG. 1*a*). With suitable drive means the elastic rail clip 51 guided in the guide slot 34 is subsequently rotated in a clockwise manner by a further 90° until it reaches the final assembly position shown in FIG. 1*b*). The pressure bow 52 bent to the outside in the process slides onto the rail foot 24. For fixing the position, suitable engagement means, for example at the end of the clip bows, must be provided which can interact with corresponding counter-engagement means in the guide ring 32, but which are not shown here. These engagement means must be designed in such a manner that on overcoming a suitable breakaway force the elastic rail clip 51 can again be rotated away from the rail foot 24 in anti-clockwise direction.

In the embodiment shown the centre axes of the centring body 12 and the guide ring 32 and thus the rotational axis D of the elastic rail clip 51 must be assumed vertically and thus parallel to the land 23 of the railway line 21. Here, the pre-tension of the elastic rail clip 51 is exclusively generated already during the inserting in the guide slot 34, wherein the pressure bow 52 braces itself on the stop element 31 in a pre-tensioned manner. However it is also possible to arrange the centre axis and thus the rotational axis of the elastic rail clip 51, starting from the centring body and the guide ring, in such a manner that the centre axis and thus the rotational axis are slightly tilted from the rail foot towards the rail head so that on rotating the elastic rail clip from the preassembly position into the assembly position an additional spring load is built-up as a result, so that the movement plane of the pressure bow 52 is an inclined slope, which results in the maximum bending-out of the pressure bow while being rotated into the final assembly position.

Figure 2A:
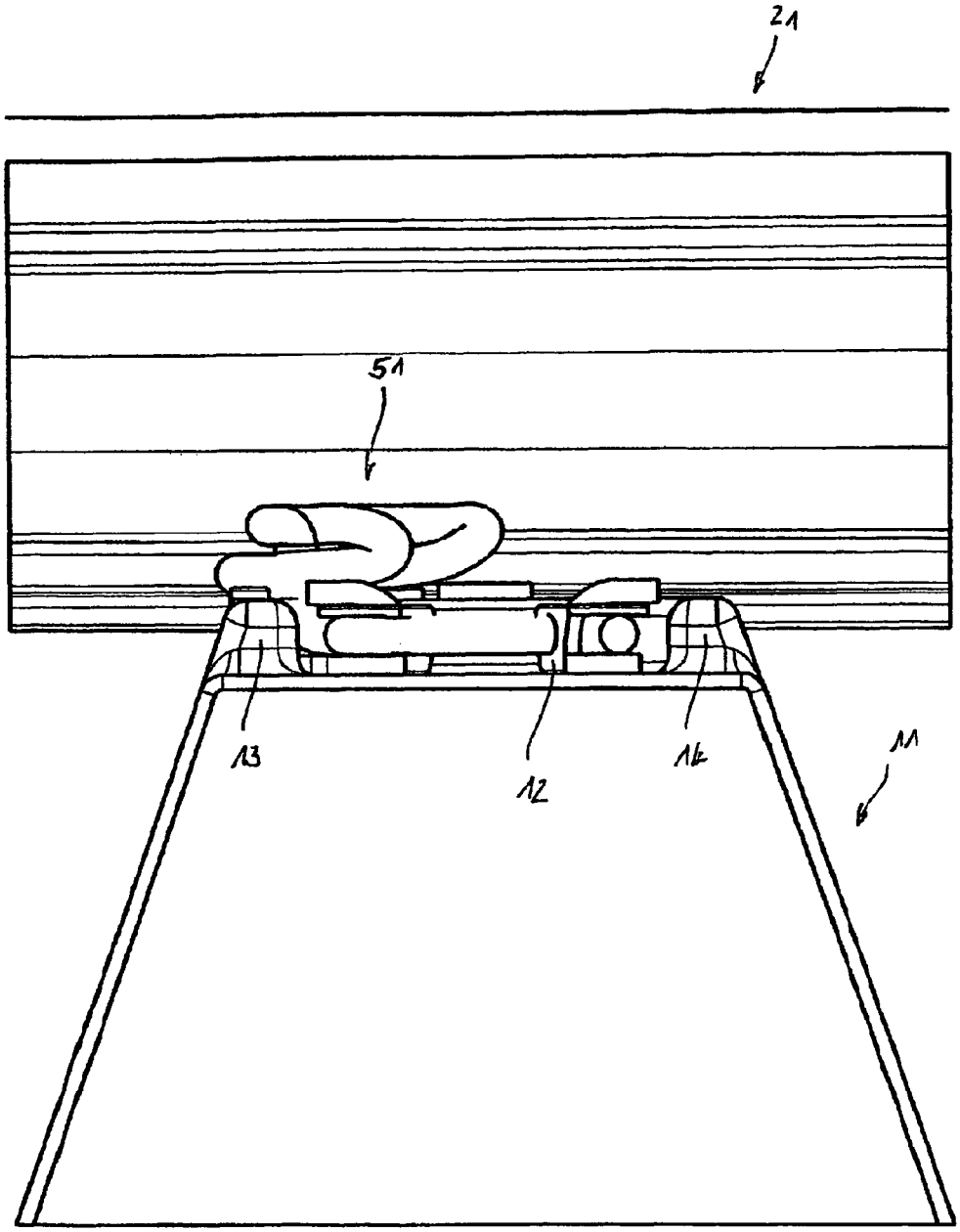
Figure 2B:
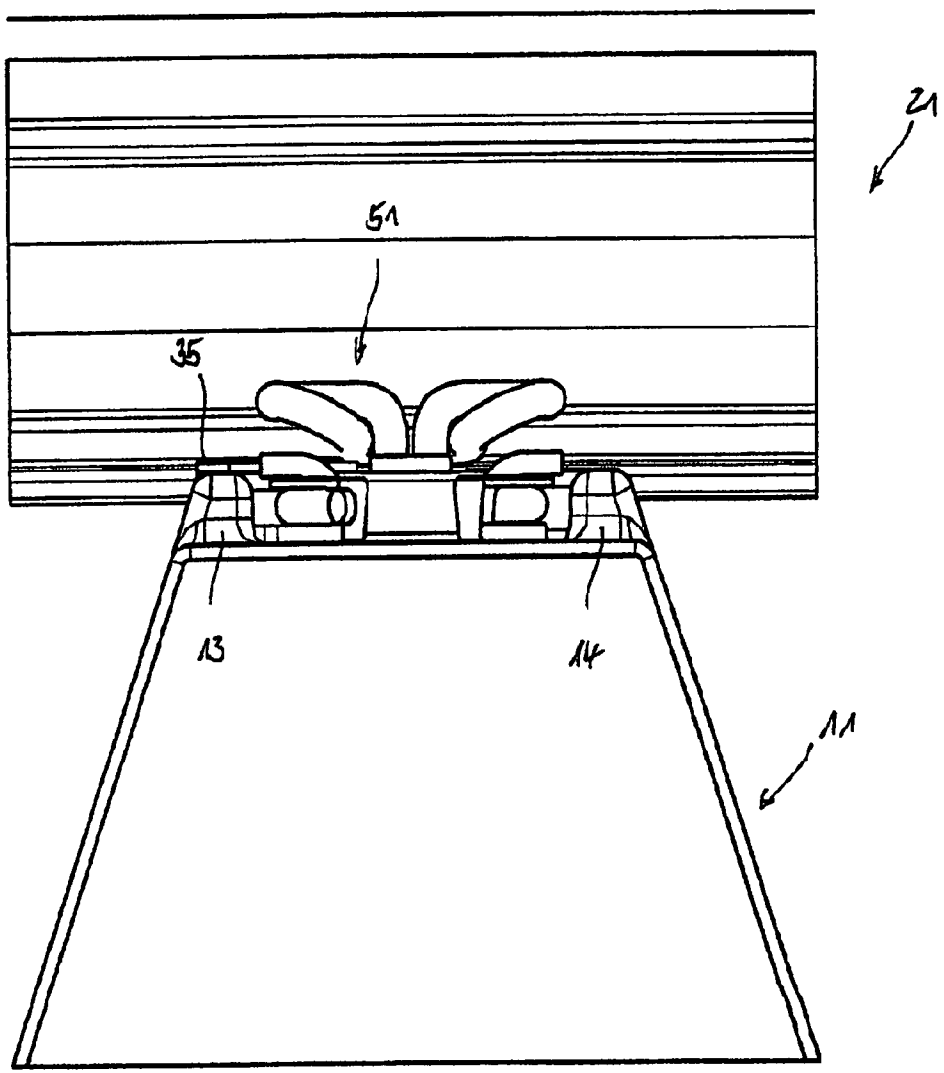
Figure 2C:
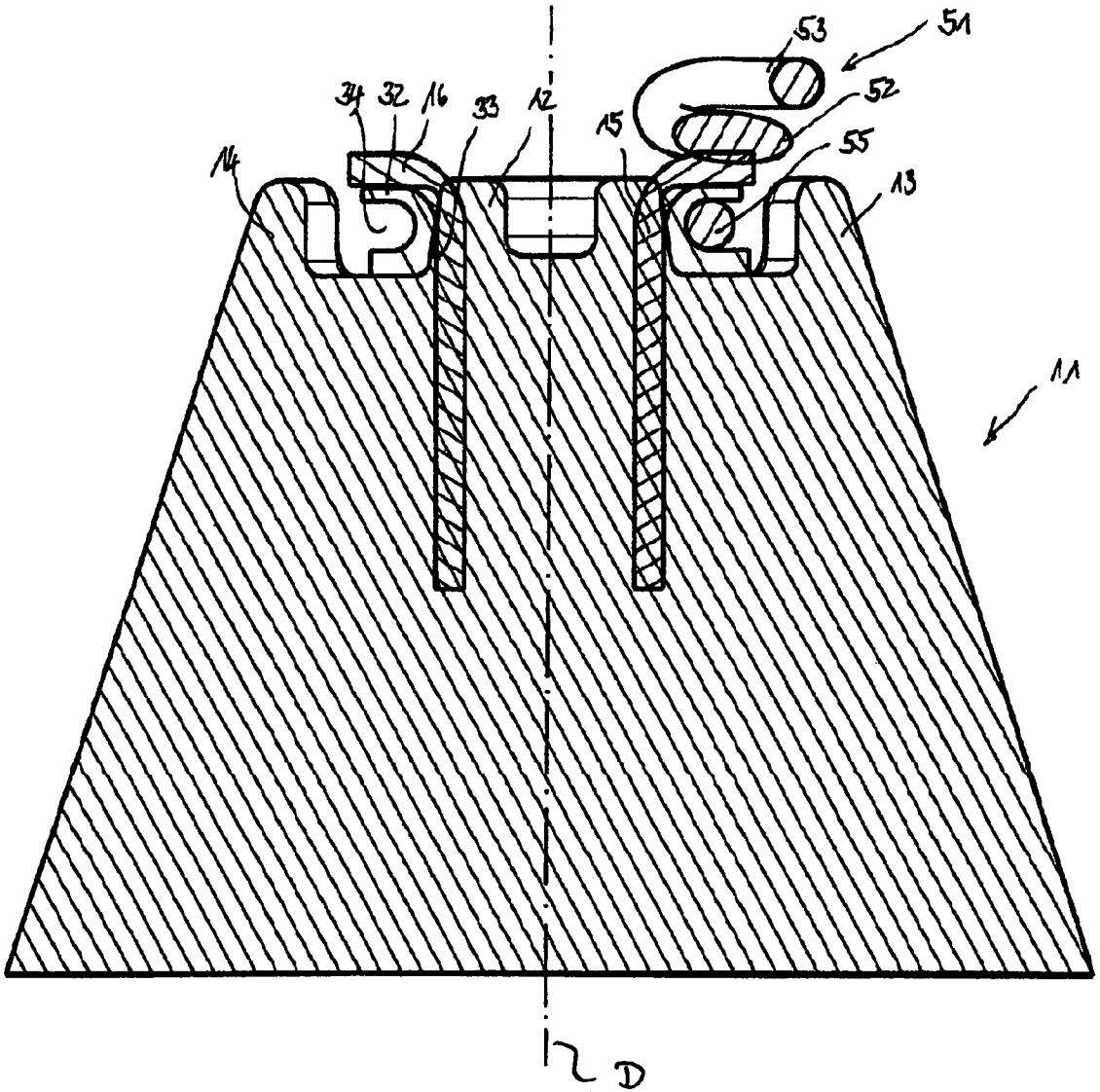

FIGS. 2*a*), 2*b*) and 2*c*) are jointly described in the following unless special reference is made to individual figures. Identical details are described with identical reference numbers as in the preceding figures to the description of which reference is made insofar. This applies more preferably to the railway line 21, the details of which are not again explained here. More preferably in the representation according to FIG. 2*c*), in which the railway line is not shown, the annular shape of the centring body 12 and the arrangement of the stop element 13, 14 by pairs is noticeable, between which, in the intermediate space, lies the guide ring 32 with its guide slot 34, which with its inner cone 33 braces itself on the centring body 12. In addition, the position and function of the anchor hooks 15, 16 is evident, which with their hook head reach over and hold-in position the guide ring 32, wherein the guide ring 32 split on the circumference however can be rotated into the position shown. In section through the elastic rail clip 51 shown in the preassembly position one of the clips 55, one of the spring loops 53 as well as in cross section a part of the pressure bow 52 are noticeable. When rotated in clockwise direction the pressure bow in this representation moves forward out of the plane of the figure where the railway line 21 must be imagined. The contact of the slide protection element 35 on the stop element 13 is noticeable in FIGS. 2*a*) and *b*), wherein the slide protection element 35 here is deformed by the pressure bow 52 in an exaggerated manner. In FIG. 2*b*) the approximately symmetrical end position of the clip bows 55, 56 is noticeable and the pre-tensioned contact of the support bow 52 on the rail foot 24 is shown in a traceable manner.

Figure 3A:
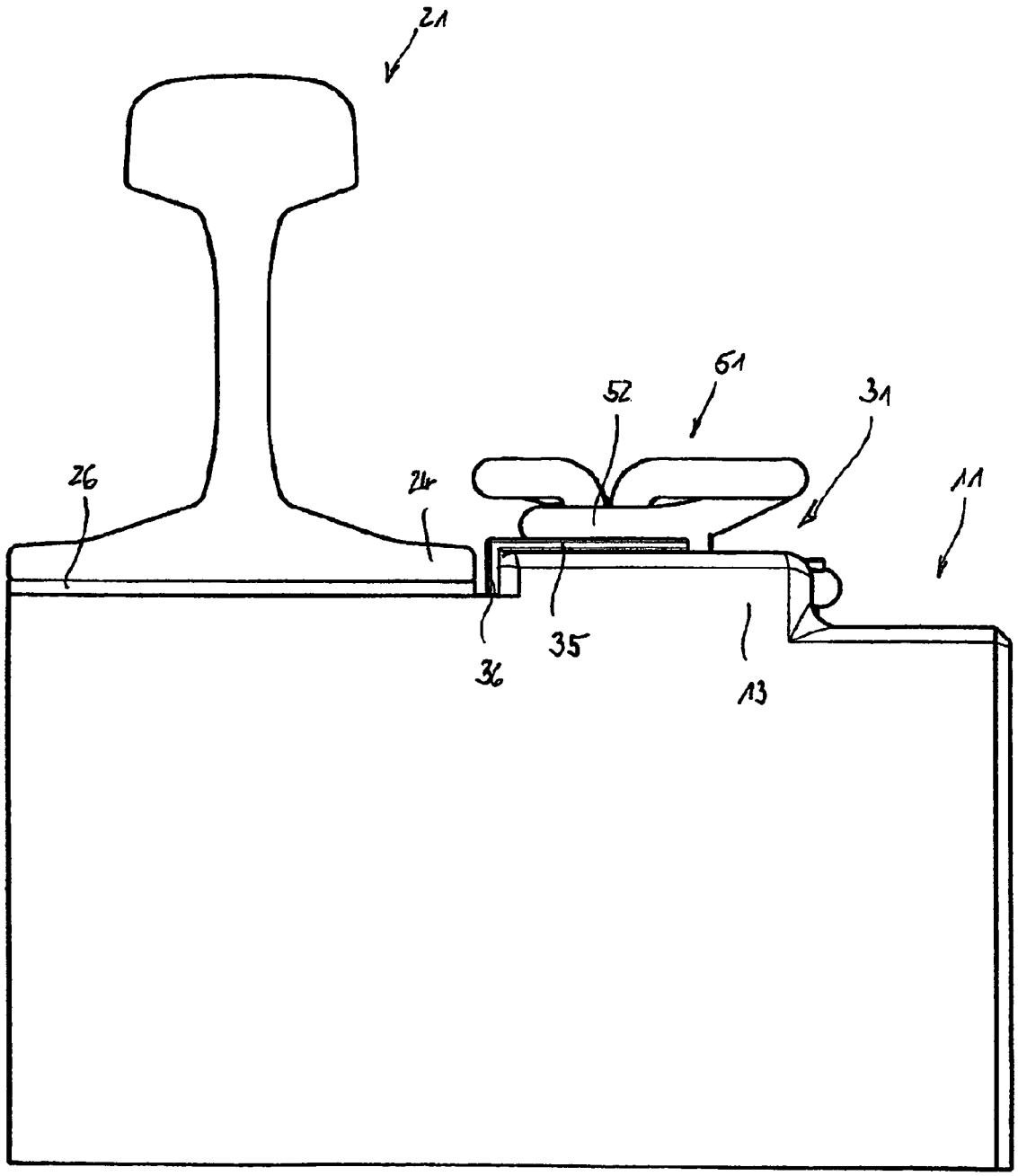
Figure 3B:
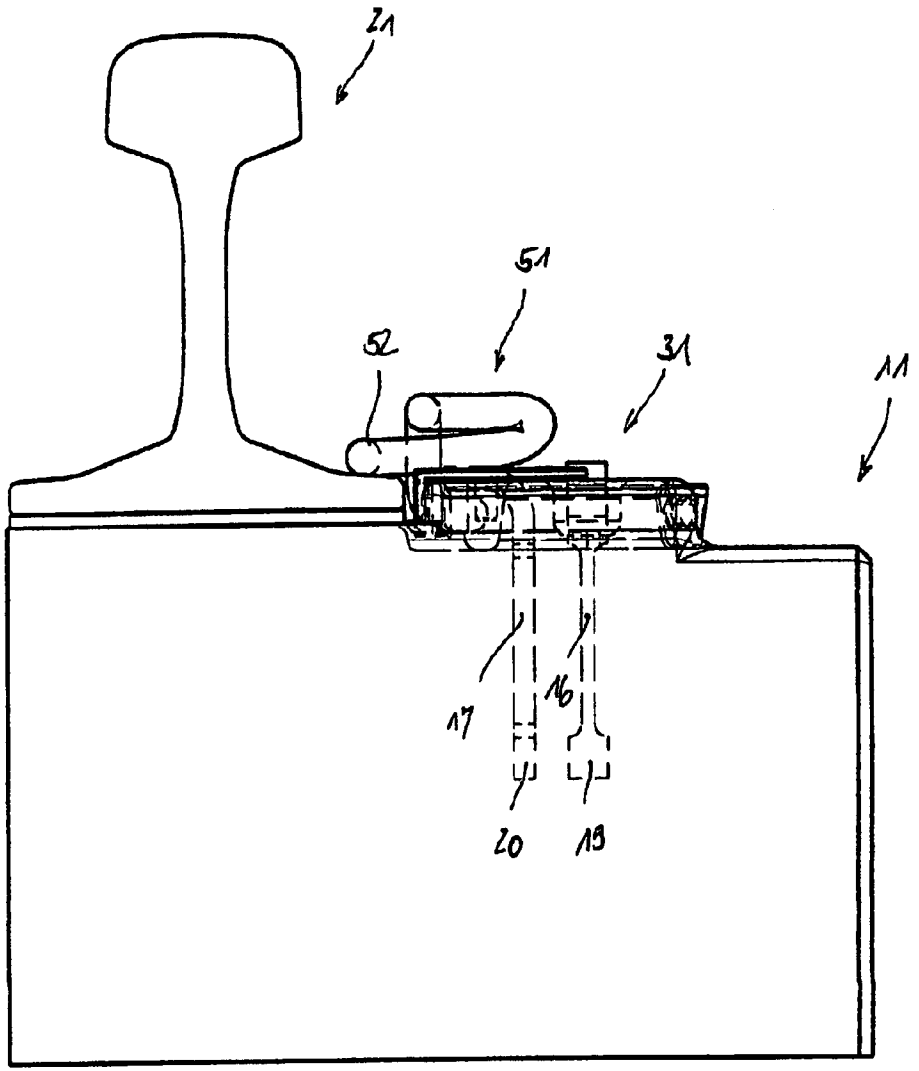

FIGS. 3*a*), 3*b*) and 3*c*) are described jointly in the following, wherein identical details are designated with identical reference numbers as in the preceding figures. Insofar reference is made to the corresponding description. The slide protection element 35 is visible in each of the FIGS. 3*a*) and 3*b*) which slide protection element separates the pressure bow 52 from the stop element during its rotary movement until the pressure bow 52 slides onto the rail foot, where metallic contact can be made. In the embodiment shown here a lateral contact between the elastic rail clip 51 and the rail foot 24 in the assembly position is likewise noticeable. Between the rail foot 24 and the stop elements 13, 14 lies the stop strip 36, wherein additional play is still present. As is more preferably visible in FIG. 3*b*) lifting of the pressure bow 52 during tilting of the rail is limited through the spring loops 53, 54 which run at a minor distance above said pressure bow. As soon as the bows 52, 53, 54 strike one another, the railway line is positively held relative to the sleeper.

Figure 3C:
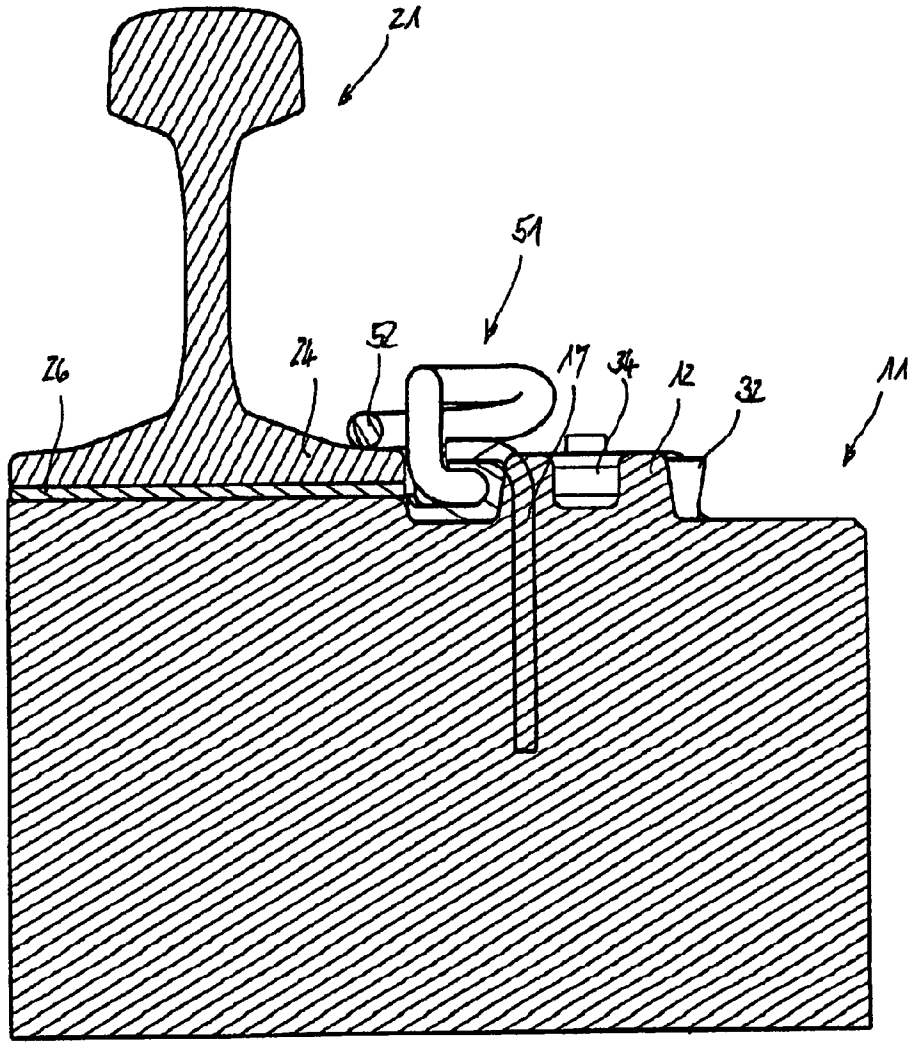

In section according to FIG. 3*c*) the position and function of the third anchor hook 17 is noticeable, which secures the guide ring 32 in the highest-loaded position. The ring-cylindrical shape of the centring body 12 is visible once more. Finally the contact of the pressure valve 52 of the elastic rail clip 51 on the rail foot 24 is very clearly visible. With appropriate pre-tension of the elastic rail clip, with which the pressure bow 52, in the pre-tensioned form following the insertion in the guide slot 34, lies at the level of the surface of the rail foot, no additional pre-tension of the pressure bow and the spring loops occurs on rotating into the assembly position shown. The slide protection element is not evident in this section.

FIGS. 4*a*) and 4*b*) are jointly described in the following. Identical details are designated with identical reference numbers as in the preceding figures. In the view according to FIG. 4*a*) more preferably the stop element 14 is noticeable on which no slide protection element is provided. While the pressure bow 52 in the preassembly position shown in FIG. 4 still rests on the slide protection element 35, this is no longer the case in the final assembly position according to FIG. 4*b*).

FIGS. 5*a*) and 5*b*) are jointly described in the following. Identical details are given identical reference numbers as in the preceding figures, to the description of which reference is made insofar. The arrangement of the stop elements 13, 14 by pairs on the sleeper 11 is clearly visible once more, between which the guide ring 32 with its circumferential division from the sleeper end, i.e. in the representation from the left, can be inserted and then rotated by 360° into its end position, wherein it is then axially secured by the anchor hooks 15, 16, 17 and is radially centred on the centring body 12. Furthermore, the contact of the pressure bow 52 of the elastic rail clip 51 on the slide protection element 35 in the preassembly position is noticeable, as well as the separation of the rail foot from the stop elements 13, 14 through the stop strip 36 of the slide protection element 35. Finally it can be traced through the cause of the elastic rail clip shown that excessive bending open of the pressure bow 52 upwards upon overload, i.e. upon commencing tilting of the railway line, is limited through the effect of the overlapping spring loops 53, 54.

FIGS. 6 to 8 show the elastic rail clip 51 with its details already mentioned above, pressure bow 52, spring loops 53, 54 and clip bows 55, 56, wherein it is noticeable that as transition from the spring loops to the clip bows vertical upright bows 57, 58 which are past through the pressure bow 52 are provided. The two approximately half-round bent clip bows 55, 56 cover a guide plane E which during the assembly can be brought to cover the guide plane covered by the guide slot in the annular body. The spring loops 53, 54 looped towards the outside, which merge into the pressure bow 52, follow via the upright bows 57, 58. Here, the ends of the spring loops 53, 54 running to the pressure bow 52 lie between the ends of the spring loops running to the upright bows 57, 58 and the clip bows 55, 56. The elastic rail clip is altogether embodied symmetrically.

FIGS. 6 and 7 show the elastic rail clip 51 in its relaxed position, while the end of the pressure bow 52 is situated near the guide plane E covered by the clip bow 55, 56 and has a greater distance to the spring loops 53, 54.

In FIG. 7, which in shape and representation corresponds to the elastic rail clip of FIG. 6, a ring segment shaped cap-like slide protection element 61 is fitted onto the pressure bow which slide protection element is permanently connected with the pressure bow and which can replace the previously described slide protection element 35 or can be added to the latter. A stop strip 62 is formed on the slide protection element 61 which can replace the previously mentioned stop strip 36.

Although shown as detail, the elastic rail clip 51 is shown in its pre-tensioned form in FIG. 1, which form it assumes in the preassembly position or the assembly position. The pressure bow 52 is bent open as far as closely to the spring loops 53, 54 and thus has a greater distance to the guide plane defined by the clip bows. Further contact of the pressure bow 52 is limited by the spring loops after a short distance.

LIST OF REFERENCE SYMBOLS

11 Sleeper
12 Centring body
13 Lateral web
14 Lateral web
15 Pulling hook
16 Pulling hook
17 Pulling hook
18 Anchor head
19 Anchor head
20 Anchor head
21 Railway line
22 Rail head
23 Land
24 Rail foot
26 Rail support
31 Fixing means
32 Guide ring
33 Inner cone
34 Guide slot
35 Slide protection element
36 Stop strip
51 Elastic rail clip
52 Pressure bow
53 Spring loop
54 Spring loop
55 Clip bow
56 Clip bow
57 Upright bow
58 Upright bow
61 Slide protection element
62 Stop strip

The invention claimed is:

1. An assembly comprising:

a sleeper; and fixing means for fixing a railway line to the sleeper, the fixing means comprising:

(a) an elastic rail clip comprising a first clip bow, a second clip bow, a pressure bow, a first spring loop having a first end and having a third end, a second spring loop having a second end and having a fourth end, and a rotational axis; and (b) a clip anchor element comprising a guide ring having an annular outer guide slot;

wherein the clip anchor element is positively held on the sleeper;

wherein the first clip bow and the second clip bow can be inserted in the clip anchor element in order to be rotatably guided about and in the rotational axis;

wherein the annular outer guide slot of the clip anchor element is concentric towards the rotational axis of the elastic rail clip when the first and second clip bows are inserted in the clip anchor element;

wherein the first clip bow and the second clip bow are shaped substantially in an annular manner and are located in a guide plane;

wherein the pressure bow is bow-shaped;

wherein the pressure bow can have pre-tensioned contact with a rail foot of the railway line when the elastic rail clip is rotated relative to the clip anchor element about the rotational axis in order to fix the railway line to the sleeper or to a stretch of track;

wherein the third end of the first spring loop connects the first spring loop to the pressure bow;

wherein the fourth end of the second spring loop connects the second spring loop to the pressure bow;

wherein the first end of the first spring loop connects the first spring loop to the first clip bow forming a first upright bow at the first end of the first spring loop;

wherein the second end of the second spring loop connects the second spring loop to the second clip bow forming a second upright bow at the second end of the second spring loop;

wherein each of the first upright bow and the second upright bow runs approximately vertically to the guide plane; and wherein the third end of the first spring loop and the fourth end of the second spring loop are guided through between the guide plane and the first end of the spring loop and between the guide plane and the second end of the second spring loop, respectively.

2. The assembly according to claim 1, wherein the sleeper comprises a centering body; and wherein the guide ring is positively held radially to the rotational axis by the centering body.

3. The assembly according to claim 2, wherein the sleeper further comprises a first stop element and a second stop element, said first and second stop elements running symmetrically to the centering body and running in a sleeper longitudinal direction, said first and second stop elements serving to support the rail foot of the railway line under transverse forces.

4. The assembly according to claim 3, wherein the elastic rail clip, with the first and second clip bows seated in the annular outer guide slot and with the resting of the pressure bow on one of the first and second stop elements, is in the tensioned state.

5. The assembly according to claim 3, wherein on at least one of the first stop element and the second stop element a slide protection element is placed, said slide protection element forming a direct support for the pressure bow of the elastic rail clip on rotating about the rotational axis.

6. The assembly according to claim 5, wherein a stop strip for the rail foot is arranged between the railway line and the first and second stop elements.

7. The assembly according to claim 6, wherein the slide protection element and the stop strip are of one piece.

8. The assembly according to claim 6, wherein the slide protection element and the stop strip consist of plastic.

9. The assembly according to claim 6, wherein the guide ring is on a side of the assembly and the slide protection element and stop strip is on an opposite side of the assembly and the guide ring, the slide protection element, and the stop strip are connected with each other.

10. The assembly according to claim 3, wherein a cap-shaped slide protection element is placed on the pressure bow, said cap-shaped protection element forming a direct support for the pressure bow on at least one of the first stop element and the second stop element and on the rail foot upon rotating about the rotational axis.

11. The assembly according to claim 10, wherein on the cap-shaped slide protection element a stop strip for the rail foot of the railway line is moulded.

12. The assembly according to claim 1, wherein the guide ring is positively held axially to the rotational axis by a plurality of anchor hook cast into the sleeper.

13. The assembly according to claim 1, wherein the guide ring is divided at a circumference of the guide ring to be able to be mounted to the centering body under elastic expansion.

14. The assembly according to claim 13, wherein the guide ring can be mounted to the centering body radially to the rotational axis in one movement.

15. The assembly according to claim 14, wherein the guide ring can be mounted to the centering body in a movement axially to the rotational axis.

16. The assembly according to claim 1, wherein the guide ring is formed of plastic.

17. The assembly according to claim 1, wherein the elastic rail clip with the first and second clip bows in a movement radially to the rotational axis can be placed on the guide ring.

18. The assembly according to claim 1, wherein the elastic rail clip with the first and second clip bows in a movement axially to the rotational axis can be placed on the guide ring.

19. The assembly according to claim 1, wherein, in the guide ring, engagement means for the elastic rail clip are provided in a position with the pressure bow resting on the rail foot.

20. Fixing means, for fixing a railway line to a sleeper or a stretch of track, comprising:

(a) an elastic rail clip comprising a first clip bow, a second clip bow, a pressure bow, a first spring loop having a first end and having a third end, a second spring loop having a second end and having a fourth end, and a rotational axis; and (b) a clip anchor element comprising guide elements;

wherein the first clip bow and the second clip bow can be inserted in the clip anchor element in order to be rotatably guided about and in the rotational axis;

wherein the guide elements are concentric towards the rotational axis of the elastic rail clip when the first and second clip bows are inserted into the clip anchor element;

wherein the first clip bow and the second clip bow are shaped substantially in an annular manner and are located in a guide plane;

wherein the pressure bow is bow-shaped;

wherein the pressure bow can have pre-tensioned contact with a rail foot of a railway line when the elastic rail clip is rotated relative to the clip anchor element about the rotational axis in order to fix the railway line to a sleeper or to a stretch of track;

wherein the third end of the first spring loop connects the first spring loop to the pressure bow;

wherein the fourth end of the second spring loop connects the second spring loop to the pressure bow;

wherein the first end of the first spring loop connects the first spring loop to the first clip bow forming a first upright bow at the first end of the first spring loop;

wherein the second end of the second spring loop connects the second spring loop to the second clip bow forming a second upright bow at the second end of the second spring loop;

wherein each of the first upright bow and the second upright bow runs approximately vertically to the guide plane; and wherein the third end of the first spring loop and the fourth end of the second spring loop are guided through between the guide plane and the first end of the spring loop and between the guide plane and the second end of the second spring loop, respectively.

21. The fixing means according to claim 20, wherein the first and second spring loops form a vertical stop for the pressure bow upon deflection under overload in the direction away from the guide plane.

22. The fixing means according to claim 20, wherein the elastic rail clip is bent of round wire.

23. Sleeper or stretch of rail with fixing means according to claim 20, wherein the clip anchor element with rotational axis located vertically to a rail support is connected with the sleeper or a rail track of the stretch of rail.

24. The sleeper or rail track with fixing means according to claim 20, wherein the rotational axis is inclined towards the sleeper or the rail track; and wherein the clip anchor element is connected with the sleeper or a rail track.

* * * * *

UNITED STATES PATENT AND TRADEMARK OFFICE

CERTIFICATE OF CORRECTION

PATENT NO. : 7,793,857 B2
APPLICATION NO. : 12/085890
DATED : September 14, 2010
INVENTOR(S) : Westerhoff et al.

It is certified that error appears in the above-identified patent and that said Letters Patent is hereby corrected as shown below:

Column 10, line 12, (Line 3 of Claim 12) after the word "anchor" please change "hook" to read:
--hooks--.

Signed and Sealed this

Ninth Day of November, 2010

David J. Kappos

David J. Kappos
*Director of the United States Patent and Trademark Office*